US009234412B2

(12) United States Patent
Getzlaf et al.

(10) Patent No.: US 9,234,412 B2
(45) Date of Patent: Jan. 12, 2016

(54) TOOLS AND METHODS FOR USE IN COMPLETION OF A WELLBORE

(75) Inventors: Donald Getzlaf, Calgary (CA); Marty Stromquist, Calgary (CA); Robert Nipper, Spring, TX (US); Timothy H. Willems, Spring, TX (US)

(73) Assignee: NCS Multistage, LLC (CA)

( * ) Notice: Subject to any disclaimer, the term of this patent is extended or adjusted under 35 U.S.C. 154(b) by 599 days.

(21) Appl. No.: 13/612,185

(22) Filed: Sep. 12, 2012

(65) Prior Publication Data

US 2013/0068451 A1 Mar. 21, 2013

Related U.S. Application Data

(63) Continuation-in-part of application No. PCT/CA2011/001167, filed on Oct. 18, 2011, which is a continuation of application No. 13/100,796, filed on May 4, 2011, now Pat. No. 8,794,331.

(60) Provisional application No. 61/394,077, filed on Oct. 18, 2010, provisional application No. 61/533,631, filed on Sep. 12, 2011.

(51) Int. Cl.

| | |
|---|---|
| ***E21B 34/14*** | (2006.01) |
| ***E21B 43/16*** | (2006.01) |
| ***E21B 23/02*** | (2006.01) |
| ***E21B 43/14*** | (2006.01) |
| ***E21B 43/25*** | (2006.01) |
| ***E21B 17/00*** | (2006.01) |
| ***E21B 33/12*** | (2006.01) |

(Continued)

(52) U.S. Cl.

CPC ..... *E21B 43/16* (2013.01); *E21B 17/00* (2013.01); *E21B 23/02* (2013.01); *E21B 33/12* (2013.01); *E21B 34/14* (2013.01); *E21B 43/00* (2013.01); *E21B 43/14* (2013.01); *E21B 43/25* (2013.01); *E21B 47/06* (2013.01)

(58) Field of Classification Search

CPC ..... E21B 34/14; E21B 47/09; E21B 43/14; E21B 33/12

See application file for complete search history.

(56) References Cited

U.S. PATENT DOCUMENTS

| | | | |
|---|---|---|---|
| 4,257,484 | A | 3/1981 | Whitley et al. |
| 4,312,406 | A | 1/1982 | McLaurin et al. |
| 4,427,070 | A | 1/1984 | O'Brien |

(Continued)

FOREIGN PATENT DOCUMENTS

| | | | |
|---|---|---|---|
| CA | 1163554 | A1 | 3/1984 |
| CA | 2121636 | A1 | 10/1994 |

(Continued)

OTHER PUBLICATIONS

"Z-Frac Straddle Packer" brochure information (3 pages).

(Continued)

*Primary Examiner* — Nicole Coy

(74) *Attorney, Agent, or Firm* — Blank Rome, LLP

(57) ABSTRACT

A ported tubular is provided for use in casing a wellbore, to permit selective access to the adjacent formation during completion operations. A system and method for completing a wellbore using the ported tubular are also provided. Ports within the wellbore casing may be opened, isolated, or otherwise accessed to deliver treatment to the formation through the ports, using a tool assembly deployed on tubing or wireline.

1 Claim, 12 Drawing Sheets

(51) Int. Cl.
*E21B 43/00* (2006.01)
*E21B 47/06* (2012.01)

(56) References Cited

U.S. PATENT DOCUMENTS

| | | | | |
|---|---|---|---|---|
| 4,470,464 | A | 9/1984 | Baldenko et al. | |
| 4,501,331 | A | 2/1985 | Brieger | |
| RE31,842 | E | 3/1985 | Weitz | |
| 4,523,643 | A | 6/1985 | McGlothen | |
| 4,834,183 | A | 5/1989 | Vinzant et al. | |
| 4,940,094 | A | 7/1990 | Lessi et al. | |
| 4,953,617 | A | 9/1990 | Ross et al. | |
| 5,033,551 | A | 7/1991 | Grantom | |
| 5,117,910 | A | 6/1992 | Brandell et al. | |
| 5,358,048 | A | 10/1994 | Brooks | |
| 5,417,291 | A | 5/1995 | Leising | |
| 6,024,173 | A * | 2/2000 | Patel et al. | 166/374 |
| 6,116,343 | A | 9/2000 | Van Petegem et al. | |
| 6,364,017 | B1 | 4/2002 | Stout et al. | |
| 6,513,595 | B1 | 2/2003 | Freiheit et al. | |
| 6,516,595 | B2 | 2/2003 | Rhody et al. | |
| 6,543,538 | B2 | 4/2003 | Tolman et al. | |
| 6,695,057 | B2 | 2/2004 | Ingram et al. | |
| 6,810,958 | B2 | 11/2004 | Szarka et al. | |
| 6,915,856 | B2 | 7/2005 | Gentry et al. | |
| 7,059,407 | B2 | 6/2006 | Tolman et al. | |
| 7,066,264 | B2 | 6/2006 | Bissonnette | |
| 7,108,067 | B2 | 9/2006 | Themig et al. | |
| 7,225,869 | B2 | 6/2007 | Willett et al. | |
| 7,278,486 | B2 | 10/2007 | Alba et al. | |
| 7,284,619 | B2 | 10/2007 | Stokley et al. | |
| 7,287,596 | B2 | 10/2007 | Frazier et al. | |
| 7,325,617 | B2 | 2/2008 | Murray | |
| 7,516,792 | B2 | 4/2009 | Lonnes et al. | |
| 7,520,333 | B2 | 4/2009 | Turner et al. | |
| 7,556,102 | B2 | 7/2009 | Gomez | |
| 7,637,317 | B1 | 12/2009 | Hernandez | |
| 7,896,082 | B2 | 3/2011 | Lake et al. | |
| 8,016,032 | B2 | 9/2011 | Mandrell et al. | |
| 2005/0072527 | A1 | 4/2005 | Gunji et al. | |
| 2005/0072577 | A1 | 4/2005 | Freeman | |
| 2005/0150661 | A1 | 7/2005 | Kenison et al. | |
| 2006/0124310 | A1 | 6/2006 | Lopez de Cardenas et al. | |
| 2006/0180319 | A1 | 8/2006 | Lucas et al. | |
| 2007/0272410 | A1 | 11/2007 | Hromas et al. | |
| 2007/0272411 | A1 | 11/2007 | Lopez De Cardenas et al. | |
| 2008/0179060 | A1 | 7/2008 | Surjaatmadja et al. | |
| 2008/0314600 | A1 | 12/2008 | Howard et al. | |
| 2009/0044944 | A1 | 2/2009 | Murray et al. | |
| 2009/0294124 | A1 | 12/2009 | Patel | |
| 2010/0108323 | A1 | 5/2010 | Wilkin | |
| 2011/0174491 | A1 * | 7/2011 | Ravensbergen et al. | 166/308.1 |
| 2011/0290486 | A1 | 12/2011 | Howard et al. | |
| 2011/0308817 | A1 | 12/2011 | Ravensbergen | |
| 2012/0086802 | A1 | 4/2012 | Eng et al. | |

FOREIGN PATENT DOCUMENTS

| | | | |
|---|---|---|---|
| CA | 2397460 | A1 | 8/2001 |
| CA | 2458433 | A1 | 8/2004 |
| CA | 2639341 | A1 | 3/2009 |
| CA | 2711329 | A1 | 1/2011 |
| CA | 2730695 | A1 | 4/2011 |
| CA | 2781721 | A1 | 9/2012 |
| EP | 589687 | A2 | 3/1994 |
| WO | WO-9625583 | A1 | 8/1996 |
| WO | WO-2008091345 | A1 | 7/2008 |
| WO | WO-2011116207 | A1 | 9/2011 |

OTHER PUBLICATIONS

Innicor Tool Information (3 Pages).
Internation Search Report for application PCT/CA2011/001167 dated Feb. 8, 2012.
"Sand Jet Perforating Revisited", SPE Drill & Completion, vol. 14, No. 1 Mar. 1999, J.S. Cobbett, pp. 28-33.
"Tubing-Conveyed Perforating With Hydraulic Set Packers and a New High-Pressure Retrievable Hydraulic Packer" SPE 13372, Hailey and Donovan 1984.
"Advances in Sand Jet Perforating", SPE 123569, Dotson, Far and Findley, 2009, pp. 1-7.
"High-Pressure/High-Temperature Coiled Tubing Casing Collar Locator Provides Accurate Depth Control for Single-Trip Perforating" SPE 60698, Connell et al, 2000, pp. 1-9.
"Investigation of Abrasive-Laden-Fluid Method for Perforation and Fracture Initiation" Journal of Petroleum Technology, Pittman, Harriman and St. John, 1961, pp. 489-495.
"Sand Jet Perforating Revisited" SPE 39597, Cobbett 1998, pp. 703-715.
"Single-Trip Completion Concept Replaces Multiple Packers and Sliding Sleeves in Selective Multi-Zone Production and Stimulation Operations" SPE 29539, Coon and Murray 1995, pp. 911-915.
Baker Oil Tools Catalogue 2002.
Tools International Corporation Catalogue 2008.
Accuracy and Reliability of coiled tubing Depth Measurement (SPE38422) Pessin, J-L, et al, 1997.
Development of a Wireless Coiled Tubing Collar Locator (SPE54327) Connell, Michael L., et al., 1999.

* cited by examiner

TOOLS AND METHODS FOR USE IN COMPLETION OF A WELLBORE

RELATED APPLICATION

This U.S. application claims priority to U.S. provisional application Ser. No. 61/533,631 filed Sep. 12, 2011 and this U.S. patent application is a continuation-in-part of, and claims priority under 35 U.S.C. §120 and 365(c) from, PCT Patent Application PCT/CA2011/001167, filed on Oct. 18, 2011, which claims priority to Canadian patent application 2,738,907 filed May 4, 2011, and to U.S. application Ser. No. 13/100,796 filed May 4, 2011, and to U.S. provisional application Ser. No. 61/394,077 filed Oct. 18, 2010, and to U.S. provisional application Ser. No. 61/533,631 filed Sep. 12, 2011. The disclosures of these prior applications are considered part of the disclosure of this application and are hereby incorporated by reference in their entireties.

FIELD OF THE INVENTION

The present invention relates generally to oil, gas, and coal bed methane well completions. More particularly, methods and tool assemblies are provided for use in accessing, opening, or creating one or more fluid treatment ports within a downhole tubular, for application of treatment fluid therethrough. Multiple treatments may be selectively applied to the formation through such ports along the tubular, and new perforations may be created as needed, in a single trip downhole.

BACKGROUND OF THE INVENTION

Various tools and methods for use downhole in the completion of a wellbore have been previously described. For example, perforation devices are commonly deployed downhole on wireline, slickline, cable, or on tubing string, and sealing devices such as bridge plugs, packers, and straddle packers are commonly used to isolate portions of the wellbore for fluid treatment.

In vertical wells, downhole tubulars may include ported sleeves through which treatment fluids and other materials may be delivered to the formation. Typically, these sleeves are run in an uncemented wellbore on tubing string, or production liner string, and are isolated using external casing packers straddling the sleeve. Such ports may be mechanically opened using any number of methods including: using a shifting tool deployed on wireline or jointed pipe to force a sleeve open mechanically; pumping a ball down to a seat to shift the sleeve open; applying fluid pressure to an isolated segment of the wellbore to open a port; sending acoustic or other signals from surface, etc. These mechanisms for opening a port or shifting a sliding sleeve may not be consistently reliable, and options for opening ports in wells of great depth, and/or in horizontal wells, are limited.

SUMMARY

In one aspect, there is provided a method for delivering treatment fluid to a formation intersected by a wellbore, the method comprising the steps of:

lining the wellbore with tubing, the liner comprising one or more ported tubular segments, each ported tubular segment having one or more lateral openings for communication of fluid through the liner to a formation adjacent the wellbore;

deploying a tool assembly downhole on tubing string, the tool assembly comprising an abrasive fluid perforation device and a sealing member;

locating the tool assembly at a depth generally corresponding to one of the ported tubular segments;

setting the sealing member against the liner below the ported tubular segment; and delivering treatment fluid to the ported tubular segment.

In an embodiment, the lateral openings are perforations created in the liner. In another embodiment, the openings are ports machined into the tubular segment prior to lining the wellbore.

In an embodiment, the sealing member is a straddle isolation device comprising first and second sealing members, and the tool assembly further comprises a treatment aperture between the first and second sealing members, the treatment aperture continuous with the tubing string for delivery of treatment fluid from the tubing string to the formation through the ports. For example, the first and/or second sealing members may be inflatable sealing elements, compressible sealing elements, cup seals, or other sealing members.

In another embodiment, the sealing member is a mechanical set packer, inflatable packer, or bridge plug.

In another embodiment, the ported tubular segment comprises a closure over one or more of the lateral openings, and the method further comprises the step of removing a closure from one or more of the lateral openings. The closure may comprise a sleeve slidingly disposed within the tubular segment, and the method may further comprise the step of sliding the sleeve to open one or more of the lateral openings.

In further embodiments, the step of sliding the sleeve comprises application of hydraulic pressure and/or mechanical force to the sleeve.

In an embodiment, the tubing string is coiled tubing.

In an embodiment of any of the aforementioned aspects and embodiments, the method further comprises the step of jetting one or more new perforations in the liner. The step of jetting one or more new perforations in the liner may comprise delivering abrasive fluid through the tubing string to jet nozzles within the tool assembly.

The method may further comprise the step of closing an equalization valve in the tool assembly to provide a dead leg for monitoring of bottom hole pressure during treatment.

In a second aspect, there is provided a method for shifting a sliding sleeve in a wellbore, comprising:

providing a wellbore lined with tubing, the tubing comprising a sleeve slidably disposed within a tubular, the tubular having an inner profile for use in locating said sleeve;

providing a tool assembly comprising: a locator engageable with said locatable inner profile of the tubular; and a resettable anchor member;

deploying the tool assembly within the wellbore on coiled tubing;

engaging the inner profile with the locator;

setting the anchor within the wellbore to engage the sliding sleeve;

applying a downward force to the coiled tubing to slide the sleeve with respect to the tubular.

In an embodiment, the step of setting the anchor comprises application of a radially outward force with the anchor to the sleeve so as to frictionally engage the sleeve with the anchor. The sleeve may comprise an inner surface of uniform diameter along its length, free of any engagement profile. The inner surface may be of a diameter consistent with the inner diameter of the tubing.

In an embodiment, the tool assembly further comprises a sealing member associated with the anchor, and wherein the method further comprises the step of setting the sealing member across the sleeve to provide a hydraulic seal across the sleeve.

In an embodiment, the step of applying a downward force comprises application of hydraulic pressure to the wellbore annulus.

In a third aspect, there is provided a method for shifting a sliding sleeve in a wellbore, comprising:

providing a wellbore lined with tubing, the tubing comprising a sleeve slidably disposed within a tubular, the tubular having an inner profile for use in locating said sleeve;

providing a tool assembly comprising: a locator engageable with said locatable inner profile of the tubular; and a resettable sealing member;

deploying the tool assembly within the wellbore on coiled tubing;

engaging the inner profile with the locator;

setting the sealing member across the sliding sleeve;

applying a downward force to the coiled tubing to slide the sleeve with respect to the tubular.

In an embodiment, the step of setting the sealing member comprises application of a radially outward force with the sealing member to the sleeve so as to frictionally engage the sleeve with the sealing member.

In an embodiment, the sleeve comprises an inner surface of uniform diameter along its length, free of any profile. The inner diameter may be consistent with the inner diameter of the tubing.

In a fourth aspect, there is provided a method for shifting a sliding sleeve in a horizontal or deviated wellbore, comprising:

providing a deviated wellbore having a sleeve slidably disposed therein providing a work string for use in engaging the sleeve, the work string comprising: a sealing element; and sleeve location means operatively associated with the sealing element;

deploying said work string within the wellbore to position the sealing element proximal to said sleeve;

setting the sealing element across the wellbore to engage the sleeve;

applying a downward force to the sealing element to shift the sliding sleeve

In an embodiment, the step of applying a downward force comprises applying hydraulic pressure to the wellbore annulus.

In a fifth aspect, there is provided a ported tubular for installation within a wellbore to provide selective access to the adjacent formation, the ported tubular comprising:

a tubular housing comprising one or more lateral fluid flow ports, the housing adapted for installation within a wellbore;

a port closure sleeve disposed against the tubular housing and slidable with respect to the housing to open and close the ports; and location means for use in positioning a shifting tool within the housing below the port closure sleeve.

In an embodiment, the location means comprises a profiled surface along the innermost surface of the housing or sleeve, the profiled surface for engaging a location device carried on a shifting tool deployable on tubing string.

In another embodiment, the location means is detectable by a wilreine logging tool.

The sleeve may have an inner surface of uniform diameter along its length, free of any engagement profile. The inner diameter may be consistent with the inner diameter of tubular segments adjacent the ported tubular segment.

In another embodiment, the ported tubular further comprises a braking mechanism for deceleration of the sliding sleeve within the housing. For example, the housing may comprise an interference profile engageable within the sliding sleeve. As another example, the housing may comprise a shoulder defining a limit to the extent of axial movement of the sliding sleeve within the housing.

In an embodiment, the sliding sleeve is tapered at a leading edge for abutment against a shoulder of the housing.

In an embodiment, the internal diameter of the housing narrows towards the shoulder to provide an interference fir between the tapered leading edge of the sliding sleeve and the shoulder of the housing.

In another aspect, there is provided a ported tubular for installation within a wellbore to provide selective access to the adjacent formation, the ported tubular comprising:

a tubular housing comprising one or more lateral fluid flow ports, the housing adapted for installation within a wellbore;

a port closure sleeve disposed against the tubular housing and slidable with respect to the housing to open and close the ports;

means for locking the slidable position of the sleeve with respect to the housing.

In an embodiment, the means for locking comprises engageable profiles along adjacent surfaces of the sleeve and housing.

In an embodiment, the port closure sleeve forms the internal diameter of the ported tubular segment.

In another embodiment, the port closure sleeve has an internal diameter comparable to the internal diameter of the wellbore.

In an embodiment, the means for locking comprises engageable profiles along opposing surfaces of the sliding sleeve and housing.

In another embodiment, the housing comprises one or more protrusions engageable with a surface of the sliding sleeve.

In an embodiment, the sliding sleeve comprises one or more protrusions engageable with the housing to limit sliding movement of the sliding sleeve with respect to the housing.

In an embodiment, the sliding sleeve comprises a set of annular teeth.

In an embodiment, the profile of the housing comprises a set of annular grooves.

In an embodiment, the ported tubular further comprises a braking mechanism for decelerating axial motion of the sliding sleeve within the housing.

In another embodiment, the housing comprises an interference profile engageable with the sliding sleeve. The housing may further comprise a shoulder, defining an axial limit to the extent of movement of the sliding sleeve within the housing. The sliding sleeve may be tapered at a leading edge for abutment against the shoulder.

In a further embodiment, the internal diameter of the housing narrows towards the shoulder to provide an interference fit between the tapered leading edge of the sliding sleeve and the shoulder of the housing.

In accordance with a further aspect of the invention, there is provided a method for delivering treatment fluid to a formation intersected by a wellbore, the method comprising the steps of:

lining the wellbore with tubing, the liner comprising one or more ported tubular segments, each ported tubular segment having one or more lateral openings for communication of fluid through the liner to a formation adjacent the wellbore, each ported tubular segment further comprising a closure sleeve slidingly disposed within the tubular segment;

providing a tool assembly comprising a resettable sealing assembly and a locating device;

lowering the tool assembly downhole locating the tool assembly within one of the closure sleeves setting the sealing assembly across the closure sleeve to hydraulically isolate the wellbore above the sealing assembly from the wellbore below the sealing assembly applying fluid to the wellbore against the sealing assembly to exceed a threshold pressure sufficient to slidably shift the closure sleeve within the tubular segment monitoring bottom hole pressure during fluid application to the wellbore;

terminating fluid application to the wellbore; and unsetting the sealing assembly from the closure sleeve In an embodiment, the closure sleeve is shifted from a position covering the lateral openings in the ported tubular segment to a position in which the lateral openings are uncovered.

In another embodiment, the step of setting the sealing assembly across the closure sleeve comprises application of a radially outward force to the closure sleeve so as to frictionally engage the closure sleeve with the sealing assembly.

The tool assembly may further comprise a pump down device, and the step of lowering the tool assembly downhole may comprise application of fluid pressure against the pump down device.

The step of setting the sealing assembly may include application of a radially outward force with a sealing member against the sleeve so as to frictionally engage the sleeve with the sealing member.

In another embodiment, the sealing assembly comprises a sealing member, a set of mechanical slips, and a pressure or temperature sensor, the sensor operatively associated with the wireline. In accordance with another aspect of the invention, there is provided a method for shifting a sliding sleeve in a wellbore, comprising the steps of:

providing a valve continuous with a wellbore tubular, the valve comprising a ported housing and a port closure sleeve slidably disposed within the ported housing;

providing a tool assembly comprising: a locating device and a resettable sealing member;

deploying the tool assembly within the wellbore on wireline;

locating the resettable sealing assembly within the port closure sleeve;

setting the sealing member across the sliding sleeve; and applying a downward force to the sealing member to slide the sleeve with respect to the ported housing.

In an embodiment, the step of setting the sealing member comprises application of a radially outward force with the sealing member to the sleeve so as to frictionally engage the sleeve with the sealing member. The sleeve may comprise an inner surface of uniform diameter along its length, free of any profile. Further, the sleeve may have an inner diameter consistent with the inner diameter of the wellbore tubular.

In another embodiment, the step of applying a downward force to the sealing member comprises delivering fluid to the wellbore to increase the hydraulic pressure above the sealing member.

In another embodiment, the port closure sleeve is initially retained in a closed position with respect to the ported housing by a hydraulic pressure above the sealing member generated by the fluid delivery is sufficient to exceed a threshold force required to overcome said retention. For example, the port closure sleeve is retained by a mating profile on the outer surface of the sleeve and the inner surface of the valve housing. In another example, the port closure sleeve is retained by a set screw.

In an embodiment, the method further comprises the step of applying treatment fluid through the valve port to an adjacent geological formation.

In an embodiment, the method further comprises the step of monitoring hydraulic pressure at the sealing element during treatment.

In an embodiment, the monitoring step comprises receiving sensed measurements from at surface during treatment.

In accordance with another aspect of the invention, there is provided a tool assembly deployed on wireline for use in actuating a sliding sleeve within a tubular, the tool assembly comprising:

a logging tool;

a resettable sealing assembly comprising a pressure sensor; and a pump down plug depending from the sealing assembly In an embodiment the pump down plug is detachable from the tool assembly. The pump down plug may be retractable.

In an embodiment, the resettable sealing assembly comprises a compressible sealing member.

In an embodiment, the tubular is wellbore casing or liner.

The sealing assembly may remain attached to the wireline during operation.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

Embodiments of the present invention will now be described, by way of example only, with reference to the attached Figures, wherein.

DETAILED DESCRIPTION

Figure 1A:
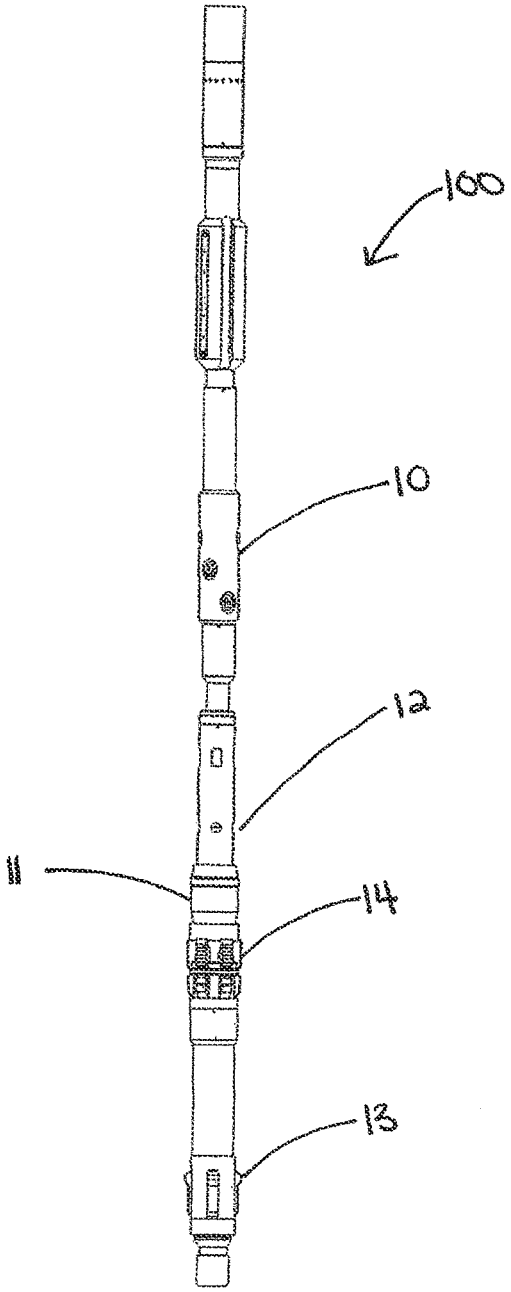
FIG. 1*a* is a perspective view of a tubing-deployed tool assembly, in one embodiment, for use in accordance with the methods described herein.

Tools and methods for use in selective opening of ports within a tubular are described. Ported tubulars may be run in hole as collars, subs, or sleeves between lengths of tubing, and secured in place, for example by cementing. The ported tubulars are spaced at intervals generally corresponding to desired treatment locations. Within each, one or more treatment ports extends through the wall of the tubular, forming a fluid delivery conduit to the formation (that is, through the casing or tubular). Accordingly, treatment fluids applied to the well may exit through the ports to reach the surrounding formation.

The ported tubulars may be closed with a sliding sleeve to prevent fluid access to the ports. Such sleeves may be shifted or opened by various means. For example, a tool assembly may interlock or mate with the tubular to confirm downhole position of the tool assembly, and the generally cylindrical sleeve may then be gripped or frictionally engaged to allow the sleeve to be driven open mechanically or hydraulically. In another embodiment, pressurized fluid may be selectively applied to a specific location to open a port or slide a sleeve as appropriate.

With reference to the embodiments shown in FIGS. 1 and 2, the tubing-deployed tool assemblies generally described below include a sealing member to facilitate isolation of a wellbore portion containing one or more ported tubulars. A perforation device may also be present within the tool assembly. Should additional perforations be desired, for example if specific ports will not open, or should the ports clog or otherwise fail to take up or produce fluids, a new perforation can be created without removal of the tool assembly from the wellbore. Such new perforations may be placed within the ported tubular or elsewhere along the wellbore.

The Applicants have previously developed a tool and method for use in the perforation and treatment of multiple wellbore intervals. That tool includes a jet perforation device and isolation assembly, with an equalization valve for controlling fluid flow through and about the assembly. Fluid treatment is applied down the wellbore annulus to treat the perforated zone.

The Applicants have also developed a downhole straddle treatment assembly and method for use in fracturing multiple intervals of a wellbore without removing the tool string from the wellbore between intervals. Further, a perforation device may be present within the assembly to allow additional perforations to be created and treated as desired, in a single trip downhole.

In the present description, the terms "above/below" and "upper/lower" are used for ease of understanding, and are generally intended to mean the relative uphole and downhole direction from surface. However, these terms may be imprecise in certain embodiments depending on the configuration of the wellbore. For example, in a horizontal wellbore one device may not be above another, but instead will be closer (uphole, above) or further (downhole, below) from the point of entry into the wellbore. Likewise, the term "surface" is intended to mean the point of entry into the wellbore, that is, the work floor where the assembly is inserted into the wellbore.

Jet perforation, as mentioned herein, refers to the technique of delivering abrasive fluid at high velocity so as to erode the wall of a wellbore at a particular location, creating a perforation. Typically, abrasive fluid is jetted from nozzles arranged about a mandrel such that the high rate of flow will jet the abrasive fluid from the nozzles toward the wellbore casing. Sand jetting refers to the practice of using sand as the abrasive agent, in an appropriate carrier fluid. For example, typical carrier fluids for use in sand jetting compositions may include one or more of: water, hydrocarbon-based fluids, propane, carbon dioxide, nitrogen assisted water, and the like. As the life of a sand jetting assembly is finite, use of ported collars as the primary treatment delivery route minimizes the need for use of the sand jetting device. However, when needed, the sand jetting device may be used as a secondary means to gain access to the formation should treatment through a particular ported collar fail.

The ported tubulars referred to herein are tubular components or assemblies of the type typically used downhole, having one or more fluid ports through a wall to permit fluid delivery from the inside of the tubular to the outside. For example, ported tubulars include stationary and sliding sleeves, collars and assemblies for use in connection of adjacent lengths of tubing, or subs and assemblies for placement downhole. In some embodiments, the ports may be covered and selectively opened. Further port conditions such as a screened port may be available by additional shifting of the sleeve to alternate positions. The ported tubulars may be assembled with lengths of non-ported tubing such as casing or production liner, for use in casing or lining a wellbore, or otherwise for placement within the wellbore.

Ported Casing Collars

Selective application of treatment fluid to individual ports, or to groups of ports, is possible using one or more of the methods described here. That is, selective, sequential application of fluid treatment to the formation at various locations along the wellbore is facilitated, in one embodiment, by providing a sliding member, such as a sleeve, piston, valve, or other cover that conceals a treatment port within a wellbore tubular, effectively sealing the port to the passage of fluid. For example, the sliding member may be initially biased or held over the treatment port, and may be selectively moved to allow fluid treatment to reach the formation through the opened port. In the embodiments shown in the Figures, the ported tubulars and sleeves are shown as collars or subs for attachment of adjacent lengths of wellbore casing. It is, however, contemplated that a similar port opening configuration could be used in other applications, that is with other tubular members, sleeves, liners, and the like, whether cemented in hole, deployed on tubing string, assembled with production liner, or otherwise positioned within a wellbore, pipe, or tubular.

Other mechanisms may also be used to temporarily cover the port until treatment is desired. For example, a burst disc, spring-biased valve, dissolvable materials, and the like, may be placed within the assembly for selective removal to permit individual treatment at each ported tubular. Such covers may be present in combination with the sliding member, for example to permit the ports to remain closed even after the sliding member has been removed from covering the port. By varying the type or combination of closures on various ports along the wellbore, more selective treatment of various intervals may be possible.

Figure 3:
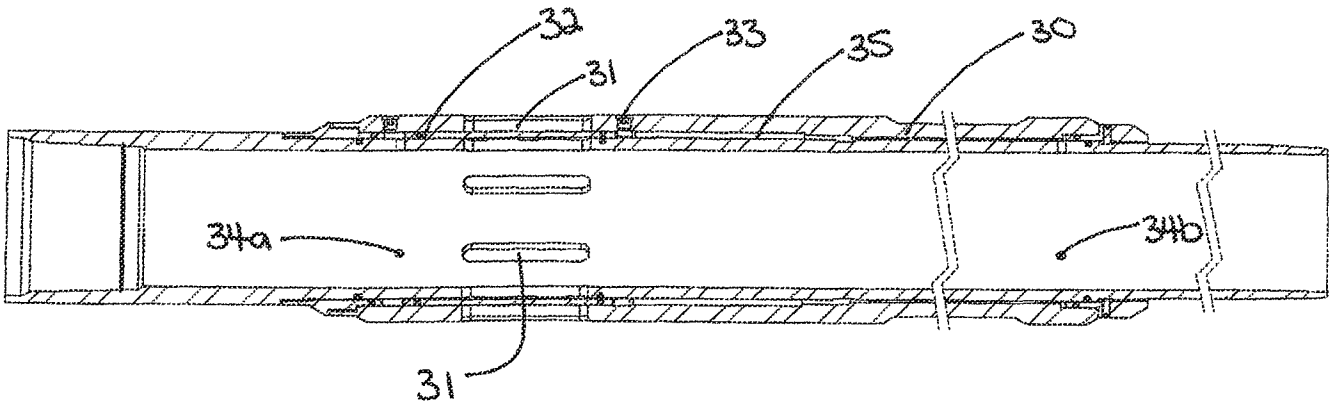
FIG. 3 is a schematic cross sectional view of a ported sub, in one embodiment, with hydraulically actuated sliding sleeve port for use in accordance with the methods described herein.

In the ported collar 30 shown in FIG. 3, an annular channel 35 extends longitudinally within the collar 30 and intersects the treatment ports 31. A sliding sleeve 32 within the channel 35 is held over the treatment ports 31 by a shear pin 33. The channel 35 is open to the inner wellbore near each end at sleeve ports 34*a*, 34*b*. The sliding sleeve 32 is generally held or biased to the closed position covering the port 31, but may be slidably actuated within the channel 35 to open the treatment port 31. For example, a seal may be positioned between the sleeve ports to allow application of fluid to sleeve port 34*a* (without corresponding application of hydraulic pressure through sleeve port 34*b*). As a result, the sleeve 32 will slide within the channel 35 toward opposing sleeve port 34*b*, opening the treatment port 31. Treatment may then be applied to the formation through the port 31. The port may or may not be locked open, and may remain open after treatment. In some embodiments, the port may be closed after treatment, for example by application of fluid to sleeve port 34*b* in hydraulic isolation from sleeve port 34*a*.

Figure 4A:
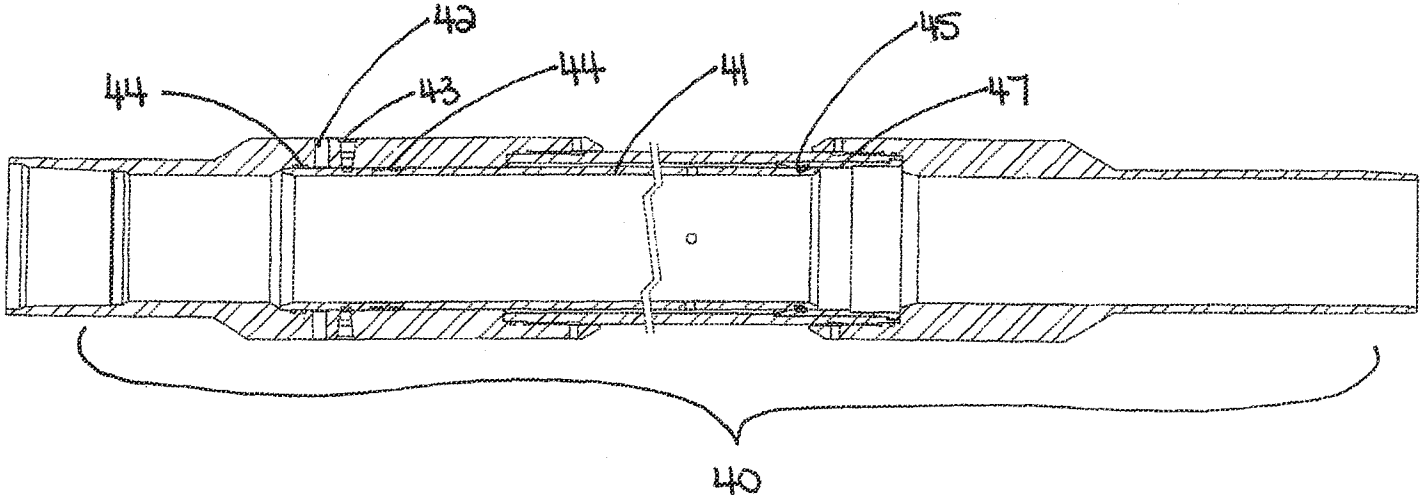
FIG. 4*a* is a perspective, partial cross-section view of a ported sub having an internal mechanically operated sliding sleeve.
Figure 4B:
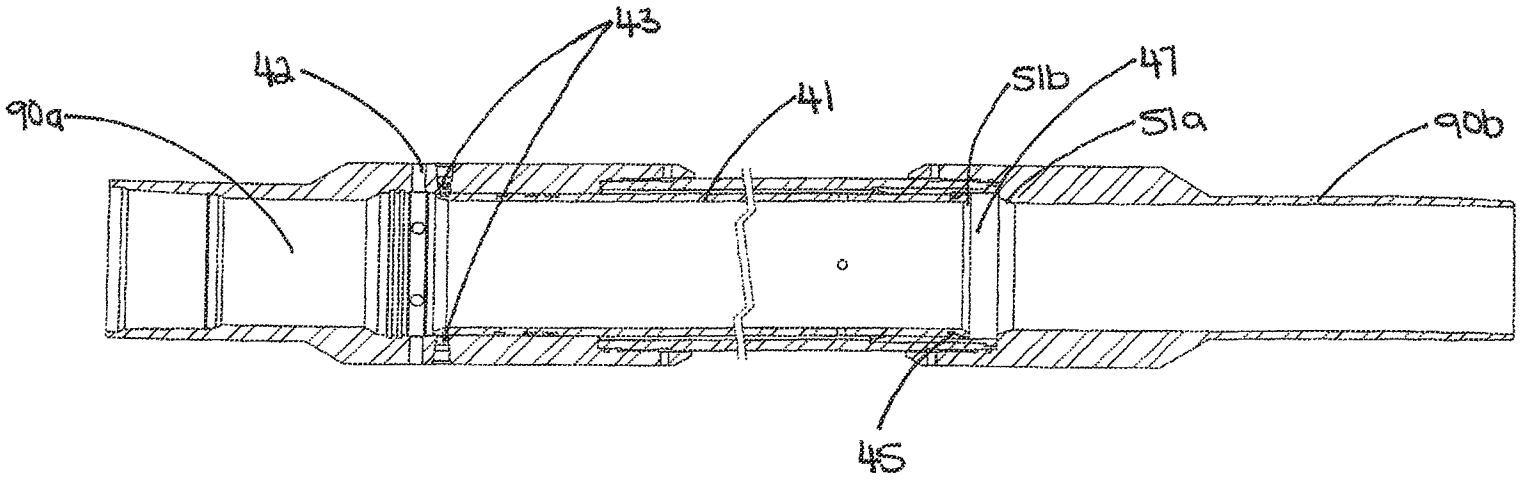
FIG. 4*b* is a perspective, cross-section view of the ported sub of FIG. 4*a*, with sliding sleeve shifted to an open port position.

With reference to FIGS. 4*a* and 4*b*, a ported sub 40 with an outer housing and inner sliding sleeve 41 is shown in port closed and port open positions, respectively. The sub may be used to connect lengths of casing or tubing as the tubing is made up at surface, prior to running in hole and securing in place with cement or external packers as desired. Ports 42 are formed through the sub 40, but not within the sliding sleeve 41. That is, the ports are closed when the sleeve is positioned as shown in FIG. 4*a*. The closed sleeve position may be secured against the collar ports using shear pins 43 or other fasteners, by interlocking or mating with a profile on the inner surface of the casing collar, or by other suitable means. A further closure (for example a dissolvable plug) may also be applied to the port if desired.

While the sleeve 41 is slidably disposed against the inner surface of the sub 40 in the port closed position, held by shear pin 43, one or more seals 44 prevent fluid flow between these surfaces. If locking of the sleeve in the port open position is desired once the sleeve has been shifted, a lockdown, snap ring 45, collet, or other engagement device may be secured about the outer circumference of the sleeve 41. A corresponding trap ring 47 having a profile, groove, detent, or trap to engage the snap ring 46, is appropriately positioned within the sub so as to engage the snap ring once the sleeve has shifted, holding the sleeve open. Accordingly, a downhole force and/or pressure may be applied to the sliding sleeve 41 to drive the sleeve 41 in the downhole direction, shearing the pin 43 and sliding the sleeve 41 so as to open the port 42 and lock it open.

A braking mechanism may be incorporated into the sleeve and/or housing to decelerate the sliding sleeve as it reaches the extent of its travel within the housing. For example, a braking mechanism may be incorporated into a lockdown, snap ring, collet, or other engagement device, or may be provided independently. An effective braking system may be useful in reducing high impact loading of the tool string during shifting of the sliding sleeve.

Figure 7A:
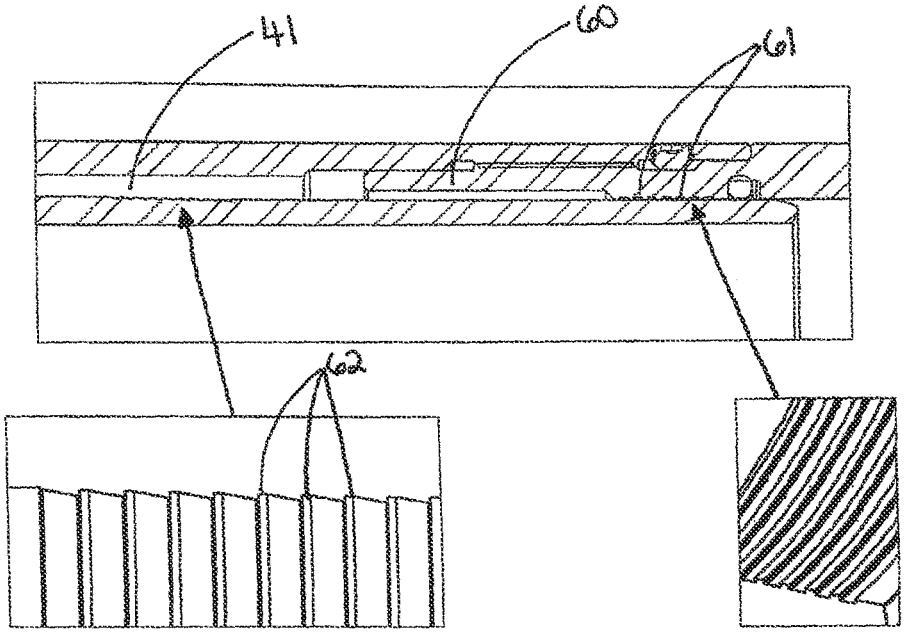
Figure 7B:
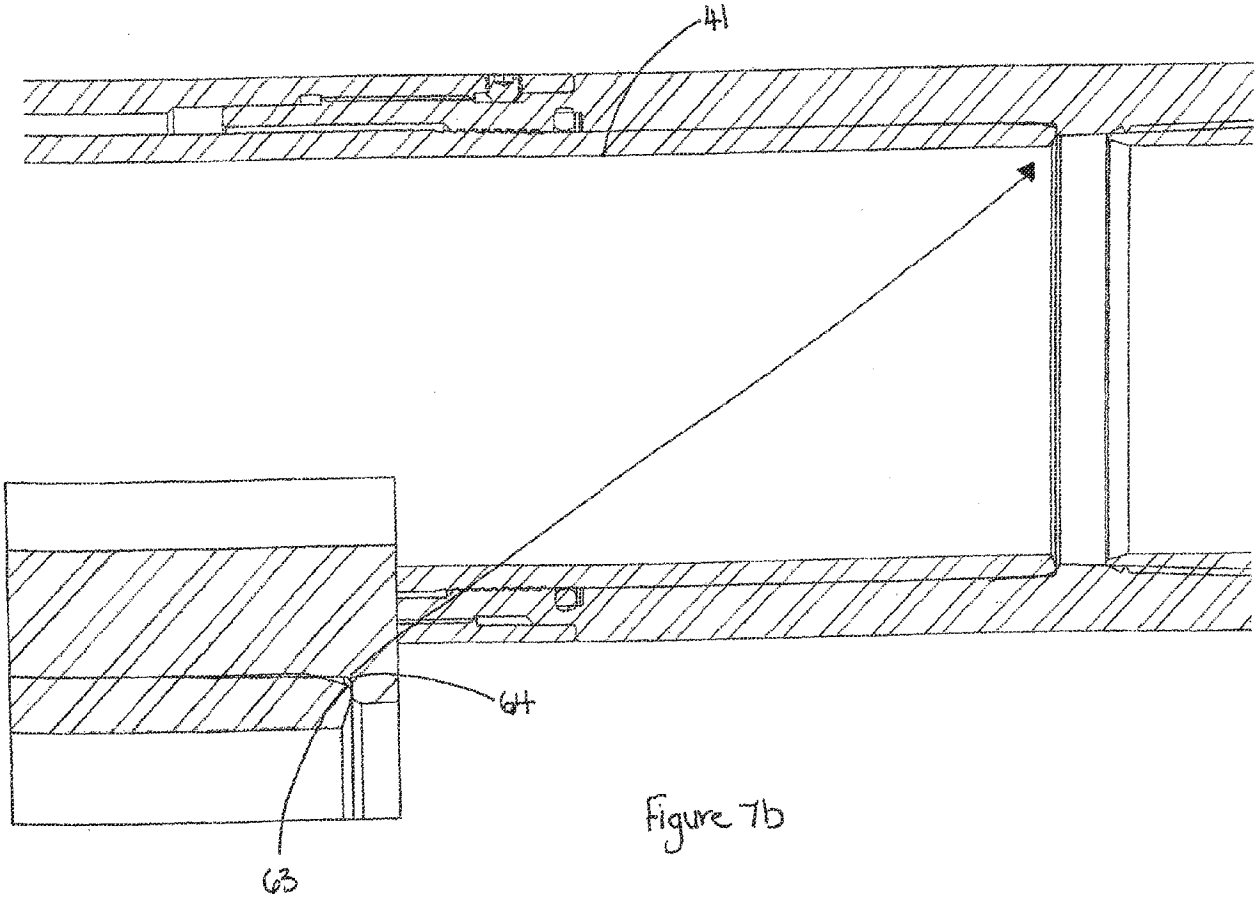

As shown in the example provided in FIGS. 7*a* and 7*b*, braking may be achieved by providing an interference fit between the sleeve and the housing, in the presence of a locking mechanism between the sleeve and housing. As shown, locking portion 60 of the housing incorporates a series of grooves or notches 61, towards the internal ends of the housing. The sliding sleeve 41 bears corresponding one-way ridges, or annular teeth 62 tapered in the direction of advancement within the sleeve, such that advancement of the threaded portion of the sleeve past the notches of the locking portion 60 of the housing will provide a ratchet effect, preventing movement of the sleeve in the reverse direction. In addition, the notches may provide sufficient mechanical interference to provide some axial deceleration of the sliding sleeve with respect to the housing. The notches may be tapered in the opposing direction to those on the sliding sleeve.

As shown in FIG. 7*b*, the sleeve has advanced and the annular teeth 62 are engaged with the notches 61 of the housing, preventing movement in the reverse direction. Further braking and locking is provided by the interference fit of the tapered leading edge 63 of the sliding sleeve against the shoulder 64 of the housing. That is, as the sliding sleeve is advanced with significant force, the leading tapered edge 63 of the sliding sleeve 41 will be deflected to a minimal extent—as the internal diameter of the housing narrows toward the shoulder. As the tapered leading edge of the sleeve further advances towards/against the shoulder (for example, upon excessive force driving the sliding sleeve), increasing mechanical interference will be encountered, further decelerating axial movement of the sliding sleeve.

Additional or alternative braking mechanisms may include shear pins, set screws, ring seals, burst discs, metal springs, hydraulic metering devices, and the like.

The inner surface of the sleeve is smooth and consistent in diameter, and is also comparable in inner diameter to that of the connected lengths of tubing so as not to provide a profile narrower than the inner diameter of the tubing. That is, the sleeve does not provide any barrier or surface that will impede the passage of a work string or tool down the tubing.

The unprofiled, smooth nature of the inner surface of the sliding sleeve 41 resists engagement of the sleeve by tools or work strings that may pass downhole for various purposes, and will only be engageable by a gripping device that exerts pressure radially outward, when applied directly to the sleeve. That is, the inner surface of the sleeve is substantially identical to the inner surfaces of the lengths of adjacent pipe. The only aberration in this profile exists within the ported sub at the bottom of each unshifted sliding sleeve, or at the top of each shifted sliding sleeve, where a radially enlarged portion of the sub (absent the concentric sliding sleeve) may be detected. In unshifted sleeves, the radially enlarged portion below the unshifted sleeve may be used to locate unshifted sleeves and position a shifting tool. The absence of such a space (inability to locate) may be used to confirm that shifting of the sleeve has occurred.

The above-noted radially enlarged portion of the sub may further include a mating or locating profile for engagement by a portion of the shifting tool assembly, for example by a casing collar locator, when the tool assembly is deployed on coiled tubing. This profile would typically not be sufficient to assist in application of a shifting force to the sliding sleeve, but is provided for location and shifting confirmation purposes. Notably, when the engaging or shifting tool is deployed on wireline, a locating or mating profile may be absent along the inner surface of the sleeve and the well may instead be logged to locate sleeves using known wireline locating devices.

In the general absence of an engagement profile useful in physically shifting the sleeve, the sleeve may instead be shifted by engagement with a sealing member, packer, slips, metal or elastomeric seals, chevron seals, or molded seals. Such seals will engage the sliding sleeve by exerting a force radially outward against the sleeve. In some embodiments, such engagement also provides a hydraulic seal. Thus, once engaged, the sleeve may be shifted by application of mechanical force, for example in the case of a vertical well with a tool string deployed on jointed pipe. As another example, a sleeve within a horizontal portion of a wellbore may be shifted by application of hydraulic pressure to the wellbore once the seals have frictionally engaged the inner surface of the sliding sleeve. A suitable sealing device may be deployed on tubing, wireline, or other suitable means.

The appropriate design and placement of ported collars or subs along a casing to provide perforations or ports through the tubular will minimize the need for tripping in and out of the hole to add perforations during completion operations. Further, use of the present tool assemblies for shifting sliding sleeves will also provide efficiencies in completion operations by providing a secondary perforation means deployed on the work string. As perforation is generally time-consuming, hazardous, and costly, any reduction in these operations improves efficiency and safety. In addition, when the pre-placed perforations can be selectively opened during a completion operation, this provides more flexibility to the well operator.

The sleeves may further be configured to prevent locking in the open position, so the ports may be actively or automatically closed after treatment is complete, for example by sliding the sleeve into its original position over the ports.

Shifting Assembly

The shifting assembly described herein includes at least a locating device and a sealing member. When the locating device confirms that the sealing member is in an appropriate well location, that is, within a sliding sleeve to be shifted, the sealing member is actuated to set across the inner diameter of the sleeve. When sealed, the portion of the wellbore above the seal is effectively hydraulically isolated from the wellbore below such that the sliding sleeve may be shifted in a downhole direction by application of fluid to the wellbore from surface. That is, as the hydraulic pressure above the sealing member increases past a threshold pressure, the force retaining the sliding sleeve in the closed position over the port will be overcome and the sliding sleeve will shift downhole to expose the open port.

When an engagement device such as a trap ring 47 is present along the housing, the snap ring 45 positioned along the sliding sleeve will become engaged with the trap ring 47 of the housing, locking the valve in the open position.

Notably, after the sleeve has been opened, the seal and work string may remain set within the wellbore to isolate the ports in the newly opened sleeve from any previously opened ports below. Alternatively, the seal may be unset for verifying the state of the opened sleeve, or to relocate the work string as necessary (for example to shift a further sliding sleeve and then apply treatment fluid to the ports of one or more collars simultaneously). Depending on the configuration of the work string, treatment fluid may be applied to the ports through one or more apertures in the work string, or via the wellbore annulus about the work string.

It is noted that the work string and components, and the sliding sleeve and casing collar shown and discussed herein, are provided as examples of suitable embodiments for opening variously configured downhole ports. Numerous modifications are contemplated and will be evident to those reading the present disclosure. For example, while downhole shifting of the sliding sleeves shown in FIGS. 3 and 4 is described herein, the sleeve, collar and work string components could be reversed such that the sleeve is shifted uphole to open the ports. Further, various forms of locating the collars and sleeves, and of shifting the sleeves, are possible. Notably, either of the tool assemblies shown in FIGS. 1 or FIG. 2 could be used to actuate either of the sliding sleeves depicted in FIG. 3 or 4 and to treat the formation through the opened ports. Various combinations of elements are possible within the scope of the teachings provided herein.

It should also be noted that shifting may be achieved even with imperfect sealing against the sliding sleeve. However, it is preferable that the integrity of the seal be monitored so the efficacy of treatment applied to the ports may be determined Measurements may therefore be recorded by the tool assembly and reviewed upon tool retrieval, or sent to surface in real time via wireline or other communication cable.

Tubing-Deployed Shifting Assembly

With reference to FIGS. 1 and 2, when the shifting assembly is deployed on tubing, a perforation device may also be provided within the tool assembly. Inclusion of a perforation device within the tool assembly allows a new perforation to be created in the event that fluid treatment through the ported housing is unsuccessful, or when treatment of additional wellbore locations not containing a ported tubular is desired. Notably, such a tool assembly allows integration of secondary perforating capacity within a fluid treatment operation, without removal of the treatment assembly from the wellbore, and without running a separate tool string downhole. In some embodiments, the new perforation may be created, and treatment applied, without adjusting the downhole location of the work string.

With reference to FIG. 1, and to Applicant's co-pending Canadian patent application 2,693,676, the content of which is incorporated herein by reference, the Applicants have described a sand jetting tool 100 and method for use in the perforation and treatment of multiple wellbore intervals. That tool included a jet perforation device 10 and a compressible sealing member 11, with an equalization valve 12 for controlling fluid flow through and about the assembly. The setting/unsetting of the sealing member using slips 14, and control over the position of the equalization valve, are both effected by application of mechanical force to the tubing string, which drives movement of a pin within an auto J profile about the tool mandrel, with various pin stop positions corresponding to set and unset seal positions. Fluid treatment is applied down the wellbore annulus when the sealing member is set, to treat the uppermost perforated zone(s). New perforations can be jetted in the wellbore by delivery of abrasive fluid down the tubing string, to reach jet nozzles.

Figure 2A:
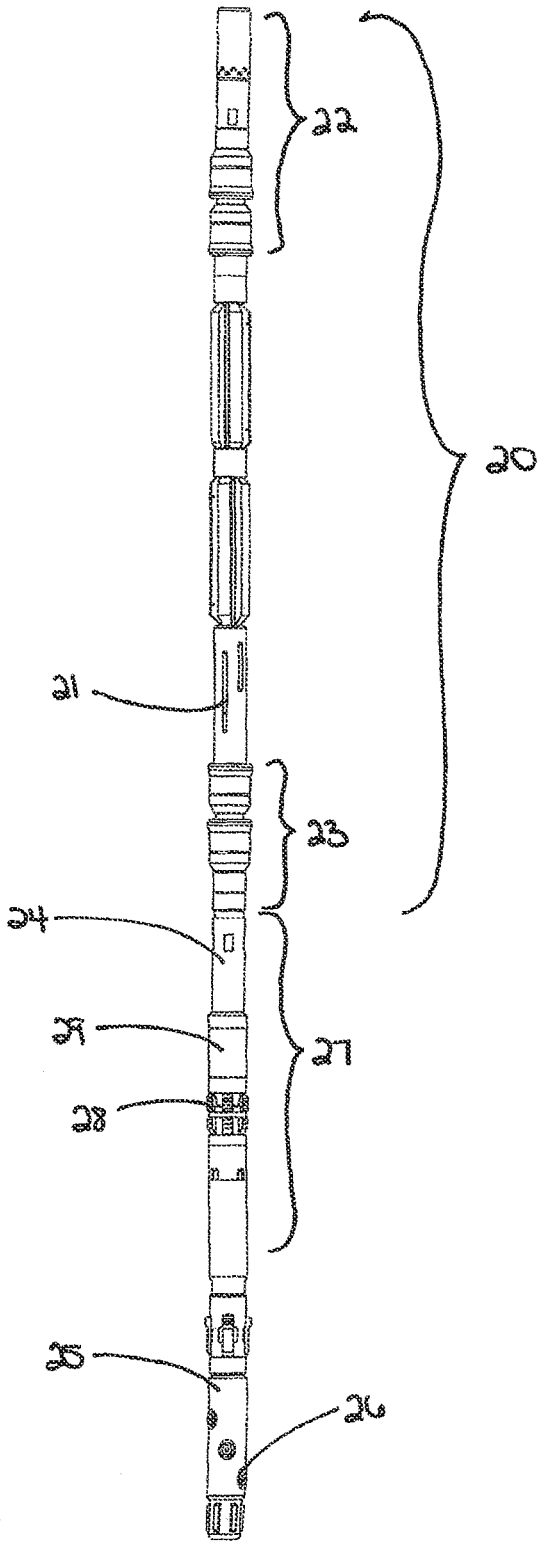
FIG. 2*a* is a perspective view of a tubing-deployed tool assembly, in another embodiment, for use in accordance with the methods described herein.
Figure 2B:
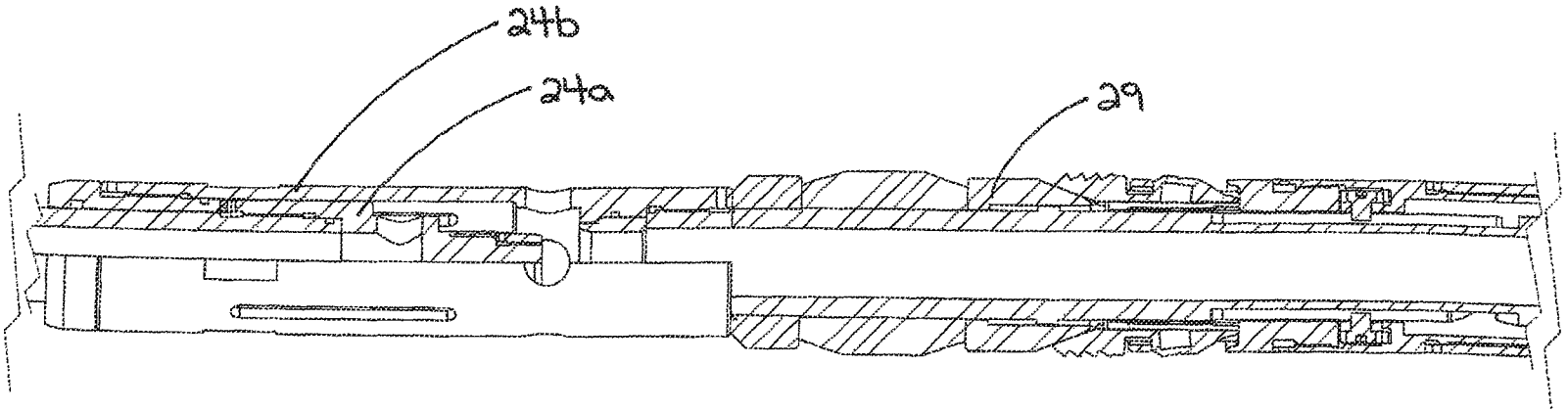
FIG. 2*b* is a schematic cross sectional view of the equalizing valve 24 shown in FIG. 2*a;*

With reference to FIGS. 2*a* and 2*b*, and to Canadian Patent No. 2,713,611, the content of which is incorporated herein by reference, the Applicants have also described a straddle assembly and method for use in fracturing multiple intervals of a wellbore without removing the work string from the wellbore between intervals. Upper straddle device 20 includes upper and lower cup seals 22, 23 around treatment apertures 21. Accordingly, fluid applied to the tubing string exits the assembly at apertures 21 and causes cup seals 22, 23 to flare and seal against the casing, isolating a particular perforation within a straddle zone, to receive treatment fluid. A bypass below the cup seals may be opened within the tool assembly, allowing fluid to continue down the inside of the tool assembly to be jetted from nozzles 26 along a fluid jet perforation device 25. An additional anchor assembly 27 may also be present to further maintain the position of the tool assembly within the wellbore, and to assist in opening and closing the bypass valve as necessary.

Figure 5A:
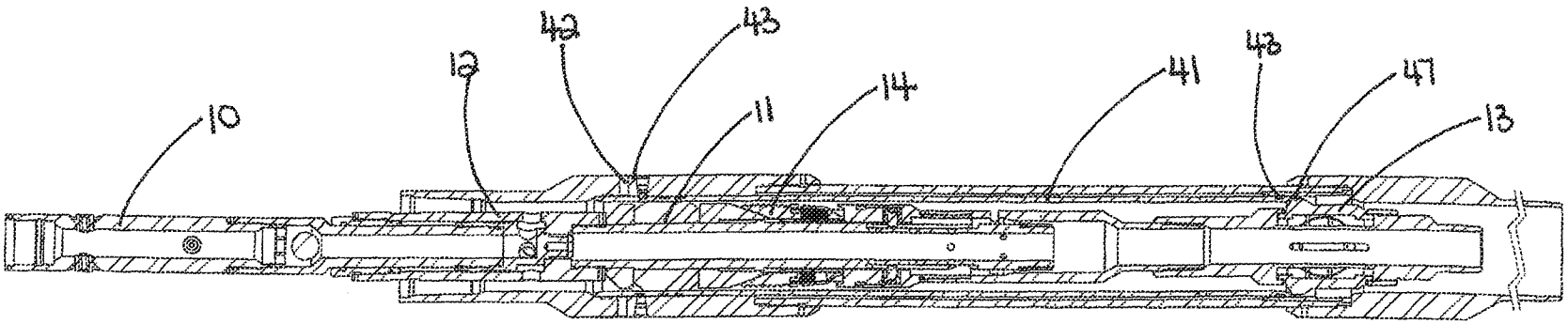
FIG. 5*a* is a perspective, partial cross-section view of the tool shown in FIG. 1*a*, disposed within the ported sub shown in FIG. 4*a;*

With reference to FIG. 5*a*, a work string for use in mechanically shifting a sliding sleeve is shown. In the embodiment shown, a mechanical casing collar locator 13 engages a corresponding profile below the unshifted sleeve within the ported tubular, the profile defined by the lower inner surface of the collar and the lower annular surface of the sliding sleeve. Once the collar locator 13 is thus engaged, a seal 11 may be set against the sliding sleeve, aided by mechanical slips 14. The set seal, for example a packer assembly having a compressible sealing element, effectively isolates the wellbore above the ported sub of interest. As force and/or hydraulic pressure is applied to the work string and packer from uphole, the sliding sleeve will be drawn downhole, shearing pin 43 and collapsing collar locator 13. The applied force and/or pressure may be a mechanical force applied directly to the work string (and thereby to the engaged sliding sleeve)

from surface, for by exerting force against coiled tubing, jointed pipe, or other tubing string. Alternatively, the applied force and/or pressure may be a hydraulic pressure applied against the seal through the wellbore annulus, and/or through the work string. Any combination of forces/pressures may be applied once the seal 11 is engaged with the sliding sleeve 41, to shift the sleeve from their original position covering the ports 42. For example, the wellbore and work string may be pressurized appropriately with fluid to aid the mechanical application of force to the work string and shift the sleeve. In various embodiments, some or all of the shifting may be accomplished by mechanical force, and in other embodiments by hydraulic pressure. In many embodiments, a suitable combination of mechanical force and hydraulic pressure will be sufficient to shift the sleeve from its original position covering the ports.

Figure 5B:
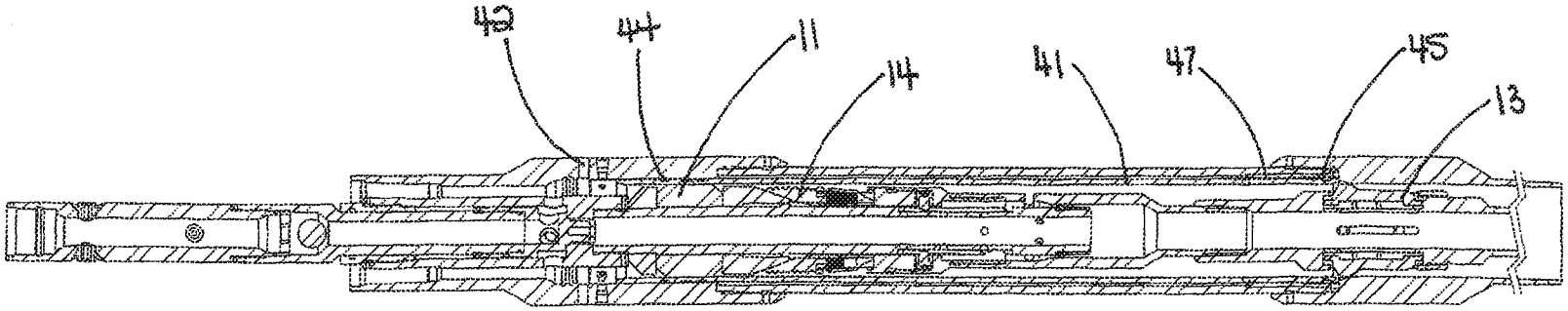
FIG. 5*b* is a partial cross-sectional perspective view of the tool shown in FIG. 1*a*, disposed within the ported sub as shown in FIG. 4*b;*

With reference to FIG. 5*b*, once the lower inner surface of the collar meets the lower annular surface of the sliding sleeve, the ports 42 are open and treatment may be applied to the formation. Further, with the sliding sleeve meeting the lower inner surface of the collar, there is no longer a locatable profile for engagement by the corresponding tubing deployed dogs/collar locator. Accordingly, the work string may be run through the sleeve without overpull, to verify that the sleeve has been opened.

Fluid treatment of the formation may be applied through the open port while the seal remains set within the sliding sleeve. In such manner, each ported location may be treated independently. Alternatively, one or more sleeves may be opened, and then treated simultaneously.

Wireline-Deployed Shifting Assembly

Figure 6:
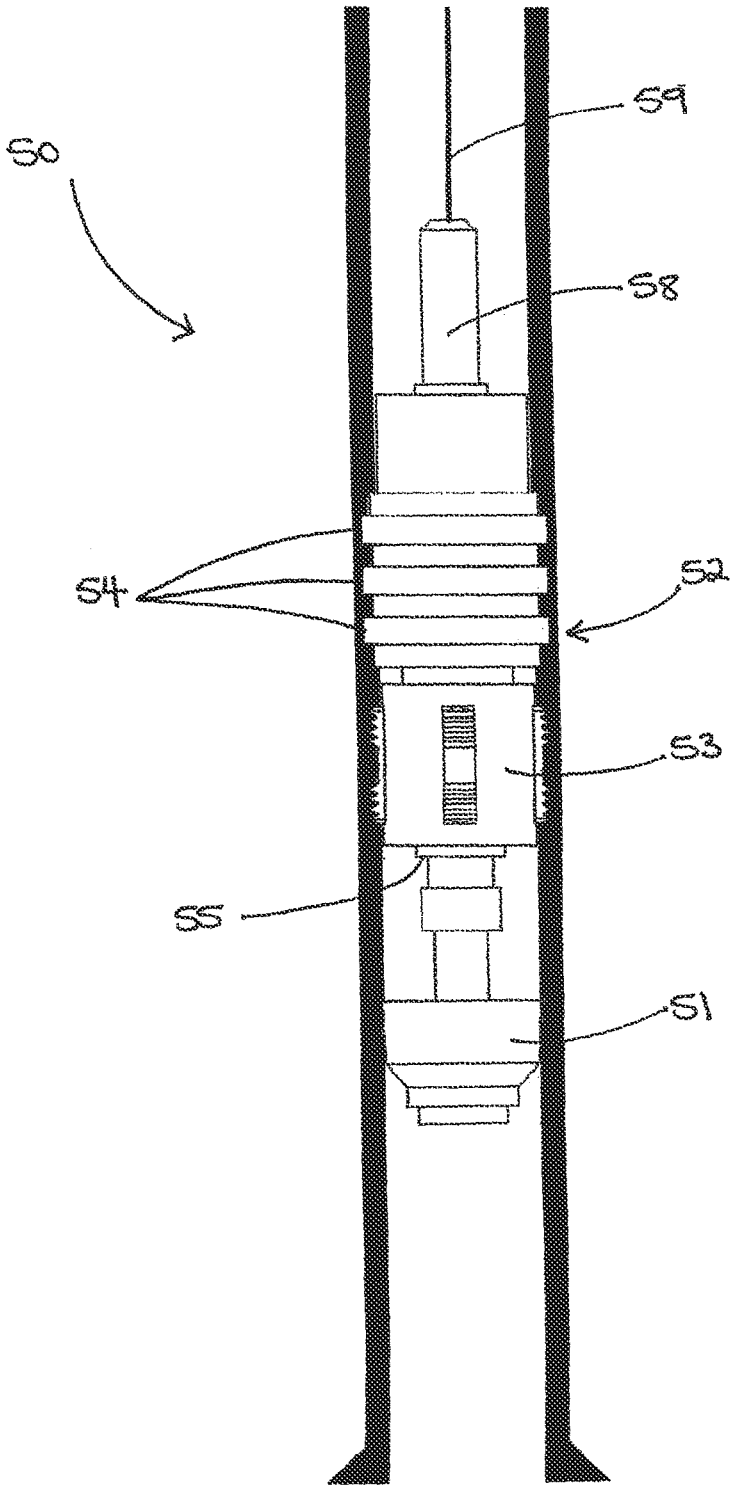
FIG. 6 is a perspective view of a wireline-deployed tool assembly, in one embodiment, for use in accordance with the methods described herein; and, FIGS. 7*a* and 7*b* are schematic cross sectional views of a sleeve locking and braking mechanism in unlocked and locked positions, respectively.

With reference to FIG. 6, a tool assembly deployed on wireline may be used to shift a sliding sleeve, opening ports in the housing for delivery of fluid to the surrounding formation. The wireline-deployed tool assembly 50 includes a sealing assembly 52 for frictionally engaging the inner surface of the sliding sleeve, a coupling for attaching the wireline to the tool assembly, and a control module for use in logging the well and controlling actuation of the sealing assembly. A pump down cup 51 may be included for use in pumping the tool downhole as needed. The tool assembly may further include other devices, such as a perforating device.

Pump down cups are typically used in lowering tools downhole when deployed on wireline, slickline, or cable. In the presently described shifting assembly, the assembly may have a diameter suitable for pumping downhole, and/or may include a pump down cup to aid delivery of the shifting assembly downhole. In an embodiment, the cup flares upon application of hydraulic pressure to the wellbore, and is therefore driven downhole by the head of hydraulic pressure behind the cup, pulling the tool assembly and wireline downhole. In this embodiment, the wellbore should be permeable, perforated, or otherwise permit fluid to pass from the well toe to the formation in order that the cup and attached tool assembly may advance to the well toe as fluid is pumped from surface. Once the tool assembly has been pumped downhole to a distance below the location of the sliding sleeve to be shifted, the pump down cup may be released, retracted, or otherwise rendered inoperable.

The sealing assembly 52 shown in FIG. 6 includes mechanical slips 53, sealing members 54, and a set of pressure sensors 55 (one above the sealing element and/or one below). When two pressure sensors are included, the pressure differential across the sealing element may be monitored. Temperature sensors may be further included for additional insight into bottom hole conditions during the operation. When appropriately located downhole, a wireline signal via the control module triggers the application of outward force by mechanical slips 53 against the casing, initiating the setting of sealing members 52 against the sliding sleeve. This sealing provides frictional engagement with the sliding sleeve such that the sliding sleeve will be shifted downward to open the housing port once the hydraulic pressure on the sealing assembly exceeds a threshold and slides from its original position covering the port. When set, the sealing assembly remains attached to the wireline, and therefore pressure sensor measurements may be transmitted to surface via wireline as required to monitor bottom hole pressure during treatment of the formation.

When the shifting assembly is run on electric line, measurement of real-time pressure and temperature above and below the sealing member is possible. A passive collar locator along the tool string locates the sleeves and casing collars all in real time. The electric line may also be used to supply power and signals from surface to open or close the equalizing valve, to set and unset the seal, and to verify the status of the sealing device and equalizing valve during treatment, or retrospectively. In adverse conditions, the wireline may be used to disconnect the shifting assembly for removal of the wireline from the wellbore.

Once treatment is complete, a wireline signal or manipulation of coiled tubing initiates hydraulic pressure equalization across the sealing assembly. In wireline embodiments, it is noted that if communication between the sealing assembly and a control module on the wireline and/or from surface can be established wirelessly, then the wireline may be disconnected from the sealing assembly during operation as desired.

It is also contemplated that the shifting assembly may be deployed on wireline contained within coiled tubing, such that some or all components of the shifting assembly may be operated and monitored via the coiled tubing-deployed shifting assembly and method disclosed herein, via the wireline assembly and method disclosed herein, or a hybrid of both.

Further, retrievable wireline-deployed bridge plugs are available, in which the bridge plug is set and then disconnected from the wireline. In the present methods, the sealing device need not be disconnected, but may remain attached at all times to facilitate communication and supply of power. Coiled tubing may contain the wireline, and be used to deliver fluid, equalize pressure, and manipulate the tool assembly when possible.

When the present shifting assemblies are run on wireline, the wireline may remain attached to the assembly at all times and may be used to deliver signals to the assembly, such as to stroke a mandrel in the sealing device to open an equalizing path through the sealing device, then release the sealing device from the sliding sleeve to repeat the operation at an unlimited number of intervals.

Methods other than stroking a mandrel to set, equalize, and release the sealing device may be used. For example, the shifting assembly may rotate to ratchet the seal into a set position, with continued rotation effecting equalization and then release of the sealing device. Many equivalent actuation operations are possible, and the present method is not limited to any one particular device for accomplishing the methods described herein.

Method

When lining a wellbore for use as discussed herein, casing is made up and run in hole, and a predetermined number of ported collars are incorporated between sections of casing at predetermined spacing. Once the casing string is in position within the wellbore, it is cemented into place. While the cementing operation may cover the outer ports of the ported collars, the cement plugs between the ported collar and the formation are easily displaced upon delivery of treatment fluid through each port as will be described below. If the well remains uncemented and the ported collars are additionally isolated using external seals, there is no need to displace cement.

Once the wellbore is ready for completion operations, a tool assembly with at least one resettable sealing or anchor member and a locating device is run downhole on coiled tubing, wireline, or other means. Depending on the configuration of the well, the tool assembly, and the method of operation of the ported collars, a particular ported sub of interest is selected and the tool assembly is positioned appropriately. Typically, the ported subs will be actuated and the well treated starting at the bottom/lowermost/deepest collar and working uphole. Appropriate depth monitoring systems are available, and can be used with the tool assembly in vertical, horizontal, or other wellbores as desired to ensure accurate positioning of the tool assembly.

Specifically, when positioning the tool assembly for operating the sliding sleeve of the ported sub shown in FIG. 3, a sealing member of the tool assembly is positioned between the sleeve ports of a single ported sub to isolate the paired sleeve ports on either side of the sealing member. Thus, when fluid is applied to the wellbore, fluid will enter the annular channel 35 at the ported collar of interest through only one of the sleeve ports, as the other sleeve port will be on the opposing side of the sealing member and will not take up fluid to balance the sleeve within the channel. In the ported collar shown in FIG. 3, fluid would be applied only to the upper sleeve port 34*a*. Accordingly, the flow of fluid into the annular channel from only one end will create hydraulic pressure within the upper portion of the annular channel, ultimately shearing the pin holding the sliding sleeve in place. The sliding sleeve will be displaced within the channel, uncovering the treatment port and allowing the passage of pressurized treatment fluid through the port, through the cement, and into the formation.

For greater clarity, the ported sub shown in FIG. 3 is opened as a result of a sealing member being positioned between its sleeve ports, which allows only one sleeve port to receive fluid, pressurizing the channel to shear the pin holding the sliding sleeve over the treatment port (or in other embodiments, forcing open the biased treatment port closure). The treatment ports within the remainder of the ported collars along the wellbore will not be opened, as fluid will generally enter both sleeve ports equally, maintaining the balanced position of the sliding sleeve over the ports in those collars.

Once treatment has been fully applied to the opened port, for example either through the tubing or down the wellbore, application of treatment fluid to the port is terminated, and the hydraulic pressure across the annular channel is dissipated. If the sliding sleeve is biased to close the treatment port, the treatment port may close when application of treatment fluid ceases. However, closure of the treatment port is not required, particularly when treatment is applied to wellbore intervals moving from the bottom of the well towards surface. That is, once treatment of the first wellbore segment is terminated, the tool assembly is moved uphole to position a sealing member between the sleeve ports of the next ported sub to be treated. Accordingly, the previously treated collar is inherently isolated from receiving further treatment fluid, and the ports may continue to be treated independently.

When a tool string having a straddle sealing assembly is available, the tool assembly may be used in at least two distinct ways to shift a sleeve. In the first instance, the straddle tool may be used in the method described above, setting the lower sealing member between the sleeve ports of a ported sub of interest and applying treatment fluid down the tubing string.

Alternatively, the method may be altered when using a straddle sealing assembly to allow the ported collars to be treated in any order. Specifically, one of the sealing members (in the assembly shown in FIG. 2, the lower sealing member) is set between the sleeve ports of a ported collar of interest. Treatment fluid may be applied down the tubing string to the isolated interval, which will enter only the upper sleeve port, creating a hydraulic pressure differential across the sliding sleeve and forcing the treatment port open.

Should the ported collar fail to open, or treatment through the ported collar be otherwise unsuccessful, the jet perforation device present on the coiled tubing-deployed assemblies shown in FIGS. 1 and 2 may be used to create a new perforation in the casing. Once the new perforation has been jetted, treatment can continue.

The method therefore allows treatment of pre-existing perforations (such as ported casing collars) within a wellbore, and creation of new perforations for treatment, as needed, with a single tool assembly and in a single trip downhole.

In the event a wireline-deployed tool assembly is used with the sliding sleeve shown in FIG. 4, the tool assembly is pumped down the wellbore, facilitated by the presence of pump down cup 51. Fluid below pump down cup 51 is displaced through a ported or pre-perforated portion in a lower zone or toe of the wellbore. The pump down cup is then released downhole, or otherwise retracted or inactivated to allow the tool assembly to be raised on wireline.

As the tool assembly is raised through the wellbore on wireline and sliding sleeves are located, each can be opened and treatment applied in succession.

Monitoring of Bottom Hole Pressure

During the application of fluid treatment to the formation through the ported subs in any of the embodiments discussed herein, the treatment pressure is monitored. In addition, the bottom hole pressure may also be monitored and used to determine the fracture extension pressure—by eliminating the pressure that is otherwise lost to friction during treatment applied to the wellbore.

With reference to the coiled tubing-deployed tool assembly shown in FIG. 1, bottom hole pressure may monitored via the coiled tubing while treatment is applied down the wellbore annulus. With reference to the wireline-deployed tool assembly shown in FIG. 6, bottom hole pressure may be monitored during treatment application using the bottom hole pressure sensors incorporated above and below the sealing members. These sensed measurements may be transmitted to surface via wireline.

When the shifting assembly is run on coiled tubing, the tubing surface pressure may be added to the hydrostatic pressure to derive bottom hole pressure (above the sealing member). This can further be interpreted as fracture extension pressure. A memory gauge may be included to record the pressure measurements, which may be used retrospectively to determine the integrity of the seal during treatment.

By understanding the fracture extension pressure trend (also referred to as stimulation extension pressure), early detection of solids accumulation at the ports is possible. That is, the operator will quickly recognize a failure of the formation to take up further treatment fluid by comparing the pressure trend during delivery of treatment fluid down the wellbore annulus with the bottom hole pressure trend during the same time period. Early recognition of an inconsistency will allow early intervention to prevent debris accumulation at the perforations and about the tool.

During treatment, a desired volume of fluid is delivered to the formation through the next treatment interval of interest, while the remainder of the wellbore below the treated interval (which may also have been previously treated) is hydraulically isolated from the present treatment interval. Should the treatment be successfully delivered down the annulus successfully, the sealing device may be unset and the tool assembly moved to the next ported interval of interest.

However, should treatment monitoring suggest that fluid is not being successfully delivered through the opened ports to the formation, this would indicate that solids may be settling within the annulus. In this case, various steps may be taken to clear the settled solids from the annulus such as adjusting the pumping rate, fluid viscosity, or otherwise altering the composition of the annulus treatment fluid to circulate solids to surface.

EXAMPLE 1

Tool Assembly with Single Sealing Member

With reference to the tool assembly shown in FIG. 1, a fluid jetting device is provided for creating perforations through a liner, and a sealing device is provided for use in the isolation and treatment of a perforated interval. Typically, when carrying out a standard completion operation, the tool string is assembled and deployed downhole on tubing (for example coiled tubing or jointed pipe) to the lowermost interval of interest. The sealing device 11 is set against the casing of the wellbore, abrasive fluid is jetted against the casing to create perforations, and then a fluid treatment (for example a fracturing fluid) is injected down the wellbore annulus from surface under pressure, which enters the formation via the perforations. Once the treatment is complete, the hydraulic pressure in the annulus is slowly dissipated, and the sealing device 11 is released. The tool may then be moved up-hole to the next interval of interest.

Notably, both forward and reverse circulation flowpaths between the wellbore annulus and the inner mandrel of the tool string are present to allow debris to be carried in the forward or reverse direction through the tool string. Further, the tubing string may be used as a dead leg during treatment down the annulus, to allow pressure monitoring for early detection of adverse events during treatment, to allow prompt action in relieving debris accumulation, or maximizing the stimulation treatment.

When using the tool string in accordance with the present method, perforation is a secondary function. That is, abrasive jet perforation would generally be used only when a ported collar fails to open, when fluid treatment otherwise fails in a particular zone, or when the operation otherwise requires creation of a new perforation within that interval. The presence of the ported subs between tubulars will minimize the use of the abrasive jetting device, and as a result allow more stages of treatment to be completed in a single wellbore in less time. Each ported collar through which treatment fluid is successfully delivered reduces the number of abrasive perforation operations, thereby reducing time and costs by reducing fluid and sand delivery requirements (and later disposal requirements when the well is put on production), increases the number of zones that can be treated in a single trip, and also extends the life of the jetting device.

When abrasive fluid perforation is required, and has been successfully completed, the jetted fluid may be circulated from the wellbore to surface by flushing the tubing string or casing string with an alternate fluid prior to treatment application to the perforations. During treatment of the perforations by application of fluid to the wellbore annulus, a second volume of fluid (which may be a second volume of the treatment fluid, a clear fluid, or any other suitable fluid) may also be pumped down the tubing string to the jet nozzles to avoid collapse of the tubing string and prevent clogging of the jet nozzles.

As shown in the embodiment illustrated in FIG. 1, the sealing device 11 is typically positioned downhole of the fluid jetting assembly 10. This configuration allows the seal to be set against the tubular, used as a shifting tool to shift the sleeve, provide a hydraulic seal to direct fluid treatment to the perforations, and, if desired, to create additional perforations in the tubular. Alternatively, the seal may be located anywhere along the tool assembly, and the tool string may re-positioned as necessary.

Suitable sealing devices will permit isolation of the most recently perforated or port-opened interval from previously treated portions of the wellbore below. For example, inflatable packers, compressible packers, bridge plugs, friction cups, straddle packers, and others known in the art may be useful for this purpose. The sealing device is able to set against any tubular surface, and does not require a particular profile at the sleeve in order to provide suitable setting or for use in shifting of an inner sliding sleeve, as such a profile may otherwise interfere with the use of other tools downhole. The sealing device may be used with any ported sub to hydraulically isolate a portion of the wellbore, or the sealing device may be used to set a hydraulic seal directly against an inner sliding sleeve to provide physical shifting of the sleeve, for example to open ports. The sealing device also allows pressure testing of the sealing element prior to treatment, and enables reliable monitoring of the treatment application pressure and bottomhole pressure during treatment. The significance of this monitoring will be explained below.

Perforation and treatment of precise locations along a vertical, horizontal, or deviated wellbore may be accomplished by incorporation of a depth locating device within the assembly. This will ensure that when abrasive fluid perforation is required, the perforations are located at the desired depth. Notably, a mechanical casing collar locator permits precise depth control of the sealing and anchoring device in advance of perforation, and maintains the position of the assembly during perforation and treatment. The collar locator may also be used to locate a work string at unshifted sleeves of the type shown in FIG. 5*a*.

When this tool assembly is used for perforation, the sealing device is set against the casing prior to perforation, as this may assist in maintaining the position and orientation of the tool string during perforation and treatment of the wellbore. Alternatively, the sealing assembly may be actuated following perforation. In either case, the sealing assembly is set against the casing beneath the perforated interval of interest, to hydraulically isolate the lower wellbore (which may have been previously perforated and treated) from the interval to be treated. That is, the seal defines the lower limit of the wellbore interval to be treated. Typically, this lower limit will be downhole of the most recently formed perforations, but up-hole of any previously treated jetted perforations or otherwise treated ports. Such configuration will enable treatment fluid to be delivered to the most recently formed perforations by application of said treatment fluid to the wellbore annulus from surface. Notably, when jetting new perforations in a wellbore having ported subs, in which the ports are covered, unopened ported collars will remain closed during treatment of the jetted perforation, and as a result such newly jetted perforations may be treated in isolation.

As shown, the sealing assembly 11 is mechanically actuated, including a compressible sealing element for providing a hydraulic seal between the tool string and casing when actuated, and slips 14 for engaging the casing to set the compressible sealing element. In the embodiment shown, the mechanism for setting the sealing assembly involves a stationary pin sliding within a J profile formed about the sealing assembly mandrel. The pin is held in place against the bottom sub mandrel by a two-piece clutch ring, and the bottom sub mandrel slides over the sealing assembly mandrel, which bears the J profile. The clutch ring has debris relief openings for allowing passage of fluid and solids during sliding of the pin within the J profile. Debris relief apertures are present at various locations within the J-profile to permit discharge of settled solids as the pin slides within the J profile. The J slots are also deeper than would generally be required based on the pin length alone, which further provides accommodation for debris accumulation and relief without inhibiting actuation of the sealing device. Various J profiles suitable for actuating mechanical set packers and other downhole tools are known within the art.

In order to equalize pressure across the sealing device and permit unsetting of the compressible sealing element under various circumstances, an equalization valve 12 is present within the tool assembly. While prior devices may include a valve for equalizing pressure across the packer, such equalization is typically enabled in one direction only, for example from the wellbore segment below the sealing device to the wellbore annulus above the sealing device. The presently described equalization valve permits constant fluid communication between the tubing string and wellbore annulus, and, when the valve is in fully open position, also with the portion of the wellbore beneath the sealing device. Moreover, fluid and solids may pass in forward or reverse direction between these three compartments. Accordingly, appropriate manipulation of these circulation pathways allows flushing of the assembly, preventing settling of solids against or within the assembly. Should a blockage occur, further manipulation of the assembly and appropriate fluid selection will allow forward or reverse circulation to the perforations to clear the blockage.

Figure 1B:
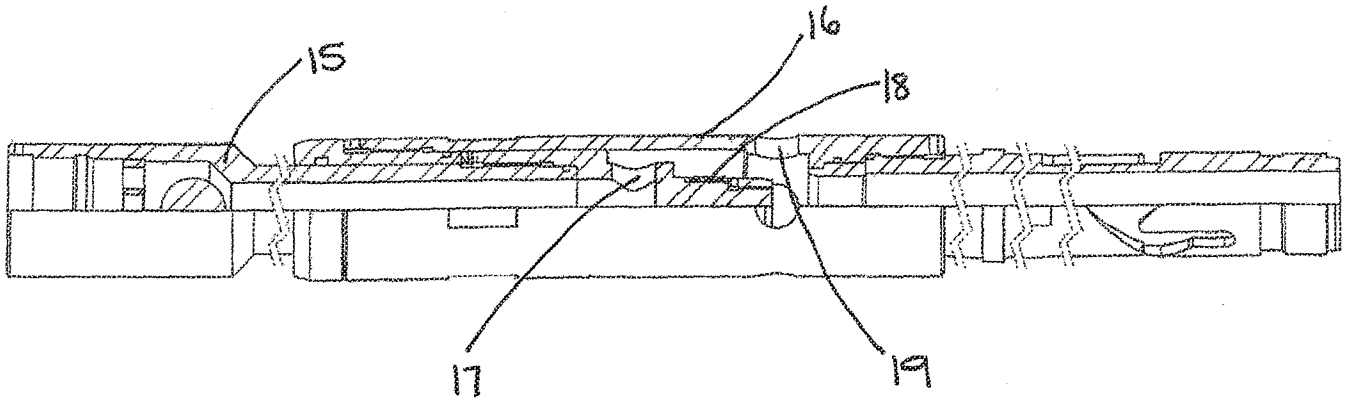
FIG. 1*b* is a schematic cross sectional view of the equalizing valve and housing shown in FIG. 1*a;*

As shown in FIG. 1*b*, the equalization valve is operated by sliding movement of an equalization plug 15 within a valve housing 16. Such slidable movement is actuated from surface by pulling or pushing on the coiled tubing, which is anchored to the assembly by a main pull tube. The main pull tube is generally cylindrical and contains a ball and seat valve to prevent backflow of fluids through from the equalization valve to the tubing string during application of fluid through the jet nozzles (located upstream of the pull tube). The equalization plug 15 is anchored over the pull tube, forming an upper shoulder that limits the extent of travel of the equalization plug 15 within the valve housing 16. Specifically, an upper lock nut is attached to the valve housing and seals against the outer surface of the pull tube, defining a stop for abutment against the upper shoulder of the equalization plug.

The lower end of the valve housing 16 is anchored over assembly mandrel, defining a lowermost limit to which the equalization plug 15 may travel within the valve housing 16. It should be noted that the equalization plug bears a hollow cylindrical core that extends from the upper end of the equalization plug 15 to the inner ports 17. That is, the equalization plug 15 is closed at its lower end beneath the inner ports, forming a profiled solid cylindrical plug 18 overlaid with a bonded seal. The solid plug end and bonded seal are sized to engage the inner diameter of the lower tool mandrel, preventing fluid communication between wellbore annulus/tubing string and the lower wellbore when the equalization plug has reached the lower limit of travel and the sealing device (downhole of the equalization valve) is set against the casing.

The engagement of the bonded seal within the mandrel is sufficient to prevent fluid passage, but may be removed to open the mandrel by applying sufficient pull force to the coiled tubing. This pull force is less than the pull force required to unset the sealing device, as will be discussed below. Accordingly, the equalization valve may be opened by application of pulling force to the tubing string while the sealing device remains set against the wellbore casing. It is advantageous that the pull tube actuates both the equalization plug and the J mechanism, at varying forces to allow selective actuation. However, other mechanisms for providing this functionality may now be apparent to those skilled in this art field and are within the scope of the present teaching.

With respect to debris relief, when the sealing device is set against the wellbore casing with the equalization plug 15 in the sealed, or lowermost, position, the inner ports 17 and outer ports 19 are aligned. This alignment provides two potential circulation flowpaths from surface to the perforations, which may be manipulated from surface as will be described. That is, fluid may be circulated to the perforations by flushing the wellbore annulus alone. During this flushing, a sufficient fluid volume is also delivered through the tubing string to maintain the ball valve within the pull tube in seated position, to prevent collapse of the tubing, and to prevent clogging of the jet nozzles.

Should reverse circulation be required, fluid delivery down the tubing string is terminated, while delivery of fluid to the wellbore annulus continues. As the jet nozzles are of insufficient diameter to receive significant amounts of fluid from the annulus, fluid will instead circulate through the aligned equalization ports, unseating the ball within the pull tube, and thereby providing a return fluid flowpath to surface through the tubing string. Accordingly, the wellbore annulus may be flushed by forward or reverse circulation when the sealing device is actuated and the equalization plug is in the lowermost position.

When the sealing device is to be released (after flushing of the annulus, if necessary to remove solids or other debris), a pulling force is applied to the tubing string to unseat the cylindrical plug 18 and bonded seal from within the lower mandrel. This will allow equalization of pressure beneath and above the seal, allowing it to be unset and moved up-hole to the next interval.

Components may be duplicated within the assembly, and spaced apart as desired, for example by connecting one or more blast joints within the assembly. This spacing may be used to protect the tool assembly components from abrasive damage downhole, such as when solids are expelled from the perforations following pressurized treatment. For example, the perforating device may be spaced above the equalizing valve and sealing device using blast joints such that the blast joints receive the initial abrasive fluid expelled from the perforations as treatment is terminated and the tool is pulled uphole.

The equalization valve therefore serves as a multi-function valve in the sealed, or lowermost position, forward or reverse circulation may be effected by manipulation of fluids applied to the tubing string and/or wellbore annulus from surface. Further, the equalization plug may be unset from the sealed position to allow fluid flow to/from the lower tool mandrel, continuous with the tubing string upon which the assembly is deployed. When the equalization plug is associated with a sealing device, this action will allow pressure equalization across the sealing device.

Notably, using the presently described valve and suitable variants, fluid may be circulated through the valve housing when the equalization valve is in any position, providing constant flow through the valve housing to prevent clogging with debris. Accordingly, the equalization valve may be particularly useful in sand-laden environments.

During the application of treatment to the perforations via the wellbore annulus, the formation may stop taking up fluid, and the sand suspended within the fracturing fluid may settle within the fracture, at the perforation, on the packer, and/or against the tool assembly. As further circulation of proppant-laden fluid down the annulus will cause further undesirable solids accumulation, early notification of such an event is important for successful clearing of the annulus and, ultimately, removal of the tool string from the wellbore. A method for monitoring and early notification of such events is possible using this tool assembly.

During treatment down the wellbore annulus using the tool string shown in FIG. 1, fluid will typically be delivered down the tubing string at a constant (minimal) rate to maintain pressure within the tubing string and keep the jet nozzles clear. The pressure required to maintain this fluid delivery may be monitored from surface. The pressure during delivery of treatment fluid to the perforations via the wellbore annulus is likewise monitored. Accordingly, the tubing string may be used as a "dead leg" to accurately calculate (estimate/determine) the fracture extension pressure by eliminating the pressure that is otherwise lost to friction during treatment applied to the wellbore. By understanding the fracture extension pressure trend (also referred to as stimulation extension pressure), early detection of solids accumulation at the perforations is possible. That is, the operator will quickly recognize a failure of the formation to take up further treatment fluid by comparing the pressure trend during delivery of treatment fluid down the wellbore annulus with the pressure trend during delivery of fluid down the tubing string. Early recognition of an inconsistency will allow early intervention to prevent debris accumulation at the perforations and about the tool.

During treatment, a desired volume of fluid is delivered to the formation through the most recently perforated interval, while the remainder of the wellbore below the interval (which may have been previously perforated and treated) is hydraulically isolated from the treatment interval. Should the treatment be successfully delivered down the annulus, the sealing device may be unset by pulling the equalization plug from the lower mandrel. This will equalize pressure between the wellbore annulus and the wellbore beneath the seal. Further pulling force on the tubing string will unset the packer by sliding of the pin to the unset position in the J profile. The assembly may then be moved uphole to perforate and treat another interval.

However, should treatment monitoring suggest that fluid is not being successfully delivered, indicating that solids may be settling within the annulus, various steps may be taken to clear the settled solids from the annulus. For example, pumping rate, viscosity, or composition of the annulus treatment fluid may be altered to circulate solids to surface.

Should the above clearing methods be unsuccessful in correcting the situation (for example if the interval of interest is located a great distance downhole that prevents sufficient circulation rates/pressures at the perforations to clear solids), the operator may initiate a reverse circulation cycle as described above. That is, flow downhole through the tubing string may be terminated to allow annulus fluid to enter the tool string through the equalization ports, unseating the ball valve and allowing upward flow through the tubing string to surface. During such reverse circulation, the equalizer valve remains closed to the annulus beneath the sealing assembly.

A method for deploying and using the above-described tool assembly, and similar functioning tool assemblies, would include the following steps, which may be performed in any logical order based on the particular configuration of tool assembly used:

- lining a wellbore, wherein the liner comprises one or more ported tubular segments, each ported tubular segment having one or more lateral treatment ports for communication of fluid from inside the liner to outside;
- running a tool string downhole to a predetermined depth corresponding to one of the ported tubular segments, the tool string including a hydra-jet perforating assembly and a sealing or anchor assembly;
- setting the isolation assembly against the wellbore casing;
- pumping a treatment fluid down the wellbore annulus from surface through the ported tubular; and
- monitoring fracture extension pressure during treatment.

In addition, any or all of the following additional steps may be performed:

- Engaging a sliding sleeve with the sealing or anchor assembly and applying a force to the sleeve to slide the sleeve;
- Opening the treatment ports;
- reverse circulating annulus fluid to surface through the tubing string;
- equalizing pressure above and below the sealing device or isolation assembly;
- equalizing pressure between the tubing string and wellbore annulus without unseating same from the casing;
- unseating the sealing assembly from the casing;
- repeating any or all of the above steps within the same wellbore interval;
- creating a new perforation in the casing by jetting abrasive fluid from the hydra jet perforating assembly; and
- moving the tool string to another predetermined interval within the same wellbore and repeating any or all of the above steps.

Should a blockage occur downhole, for example above a sealing device within the assembly, delivery of fluid through the tubing string at rates and pressures sufficient to clear the blockage may not be possible, and likewise, delivery of clear fluid to the wellbore annulus may not dislodge the debris. Accordingly, in such situations, reverse circulation may be effected while the inner and outer ports remain aligned, simply by manipulating the type and rate of fluid delivered to the tubing string and wellbore annulus from surface. Where the hydraulic pressure within the wellbore annulus exceeds the hydraulic pressure down the tubing string (for example when fluid delivery to the tubing string ceases), fluid within the equalization valve will force the ball to unseat, providing reverse circulation to surface through the tubing string, carrying flowable solids.

Further, the plug may be removed from the lower mandrel by application of force to the pull tube (by pulling on the tubing string from surface). In this unseated position, a further flowpath is opened from the lower tool mandrel to the inner valve housing (and thereby to the tubing string and wellbore annulus). Where a sealing device is present beneath the equalization device, pressure across the sealing device will be equalized allowing unsetting of the sealing device.

It should be noted that the fluid flowpath from outer ports 19 to the tubing string is available in any position of the equalization plug. That is, this flowpath is only blocked when the ball is set within the seat based on fluid down tubing string. When the equalization plug is in its lowermost position, the inner and outer ports are aligned to permit flow into and out of the equalization valve, but fluid cannot pass down through the lower assembly mandrel. When the equalization plug is in the unsealed position, the inner and outer ports are not aligned, but fluid may still pass through each set of ports, into and out of the equalization valve. Fluid may also pass to and from the lower assembly mandrel. In either position, when the pressure beneath the ball valve is sufficient to unseat the ball, fluid may also flow upward through the tubing string.

The sealing device may be set against any tubular, including a sliding sleeve as shown in FIG. 4. Once set, application of force (mechanical force or hydraulic pressure) to the sealing device will drive the sliding sleeve downward, opening the ports.

EXAMPLE 2

Tool Assembly with Straddle Seals

With reference to the tool assembly shown in FIG. 2, a tool string is deployed on tubing string such as jointed pipe, concentric tubing, or coiled tubing. The tool string will typically include: a treatment assembly with upper and lower isolation elements, a treatment aperture between the isolation elements, and a jet perforation device for jetting abrasive fluid against the casing. A bypass valve and anchoring assembly may be present to engage the casing during treatment.

Various sealing devices for use within the tool assembly to isolate the zone of interest are available, including friction cups, inflatable packers, and compressible sealing elements. In the particular embodiments illustrated and discussed herein, friction cups are shown straddling the fracturing ports of the tool. Alternate selections and arrangement of various components of the tool string may be made in accordance with the degree of variation and experimentation typical in this art field.

As shown, the anchor assembly 27 includes an anchor device 28 and actuator assembly (in the present drawings cone element 29), a bypass/equalization valve 24. Suitable anchoring devices may include inflatable packers, compressible packers, drag blocks, and other devices known in the art. The anchor device depicted in FIG. 2 is a set of mechanical slips driven outwardly by downward movement of the cone 29. The bypass assembly is controlled from surface by applying a mechanical force to the coiled tubing, which drives a pin within an auto J profile about the tool mandrel.

The anchoring device is provided for stability in setting the tool, and to prevent sliding of the tool assembly within the wellbore during treatment. Further, the anchoring device allows controlled actuation of the bypass valve/plug within the housing by application of mechanical force to the tubing string from surface. Simple mechanical actuation of the anchor is generally preferred to provide adequate control over setting of the anchor, and to minimize failure or debris-related jamming during setting and releasing the anchor. Mechanical actuation of the anchor assembly is loosely coupled to actuation of the bypass valve, allowing coordination between these two slidable mechanisms. The presence of a mechanical casing collar locator, or other device providing some degree of friction against the casing, is helpful in providing resistance against which the anchor and bypass/equalization valve may be mechanically actuated.

That is, when placed downhole at an appropriate location, the fingers of the mechanical casing collar locator provide sufficient drag resistance for manipulation of the auto J mechanism by application of force to the tubing string. When the pin is driven towards its downward-most pin stop in the J profile, the cone 29 is driven against the slips, forcing them outward against the casing, acting as an anchor within the wellbore. When used in accordance with the present method, the tool is positioned with one or both sets of friction cups between the sleeve ports 34 of the annular channel 35 in the ported casing collar 30. Treatment fluid is applied to one of the sleeve ports (in the collar shown in FIG. 3, to the upper port 34*a*), driving the sliding sleeve 33 downward toward the lower sleeve port 34*b*. Once the treatment port 31 has been uncovered, treatment fluid will enter the port. Pressurized delivery of further amounts of fluid will erode any cement behind the port and reach the formation.

With reference to FIG. 2*b*, the bypass valve includes a bypass plug 24*a* slidable within an equalization valve housing 24*b*. Such slidable movement is actuated from surface by pulling or pushing on the tubing, which is anchored to the assembly by a main pull tube. The main pull tube is generally cylindrical and provides an open central passageway for fluid communication through the housing from the tubing. The bypass plug 24*a* is anchored over the pull tube, forming an upper shoulder that limits the extent of travel of the bypass plug 24*a* within the valve housing 24*b*. Specifically, an upper lock nut is attached to the valve housing 24*b* and seals against the outer surface of the pull tube, defining a stop for abutment against the upper shoulder of the bypass plug 24*a*.

The lower end of the valve housing 24*b* is anchored over a mandrel, defining a lowermost limit to which the bypass plug 24*a* may travel within the valve housing 24*b*. The bypass plug 24*a* is closed at its lower end, and is overlaid with a bonded seal. This solid plug end and bonded seal are sized to engage the inner diameter of the lower tool assembly mandrel, preventing fluid communication between wellbore annulus/tubing string and the lower wellbore when the bypass plug 24*a* has reached the lower limit of travel.

Closing of the bypass prevents fluid passage from the tubing string to below, but the bypass may be opened by applying sufficient pull force to the coiled tubing. This pull force is less than the pull force required to unset the anchor due to the slidability of the bypass plug 24*a* within the housing 24*b*. Accordingly, the equalization valve may be opened by application of pulling force to the tubing string while the anchor device remains set against the wellbore casing. This allows equalization of pressure from the isolated zone and unsetting of the cup seals without slippage and damage to the cup seals while pressure is being equalized.

Notably, the bypass valve 24 provides a central fluid passageway from the tubing to the lower wellbore. Bypass plug 24*a* is slidable within the assembly upon application of force to the tubing string, to open and close the passageway. Notably, while the states of the bypass and anchor are both dependent on application of force to the tubing string from surface, the bypass plug is actuated initially without any movement of the pin within the J slot.

When this tool string is assembled and deployed downhole on tubing for the purpose of shifting the sliding sleeve shown in FIG. 3, it may be positioned with the lower cup between the sleeve ports of a particular ported collar of interest. That is, the lower seals are positioned below the treatment port, but above the lower sleeve port. The bypass valve 24 is closed and the anchor set against the casing, and fluid is pumped down the tubing under pressure, exiting the tubing string at treatment apertures 21, as the closed bypass valve prevents fluid from passing down the tool string to the jet perforation device 25. Fluid delivery through the apertures 11 results in flaring of the friction cups 22, 23, with the flared cups sealing against the casing. Once the cups have sealed against the wellbore, the hydraulic pressure will rise within the isolated interval, and fluid will enter the upper sleeve port, ultimately displacing the sliding sleeve and opening the treatment port. Once opened, continued delivery of fluid will result in erosion of any cement behind the treatment port, and delivery of treatment fluid to the formation.

When treatment is terminated, the bypass valve 24 is pulled open to release pressure from the isolated zone, allowing fluid and debris to flow downhole through the bottom portion of the tool string. Once the pressure within the fractured zone is relieved, the cup seals relax to their running position. When treatment is complete, the cone 29 is removed from engagement with the inwardly-biased slips by manipulation of the pin within the J profile to the release position, allowing retraction of the slips 28 from the casing. The anchor is thereby unset and the tool string can be moved to the next interval of interest or retrieved from the wellbore.

If perforation of the wellbore is desired, the bypass valve 24 is open and the friction cups are set across the wellbore above the zone to be perforated. Pumping abrasive fluid down the tubing string will deliver fluid preferentially through the treatment ports 11 until the friction cups seal against the wellbore. As this interval is unperforated, once the interval is pressurized, fluid will be directed down the assembly to exit jet nozzles 26. Continued delivery of fluid will result in jetting of abrasive fluid against the casing to perforate the wellbore adjacent the jet nozzles. When fluid pressure is applied the cup seals will engage the casing, and the tool string will remain fixed, stabilizing the jet sub while abrasive fluid is jetted through nozzles 26.

In order to allow fluid delivered to the tubing string to reach jet nozzles 26, the bypass valve must be in the open position. It has been noted during use that when fluid is delivered to the bypass valve at high rates, the pressure within the valve typically tends to drive the valve open. That is, a physical force should be applied to hold the valve closed, for example by setting the anchor. Accordingly, when jet perforation is desired, the valve is opened by pulling the tubing string uphole to the perforation location. When fluid delivery is initiated with the bypass valve open, the hydraulic pressure applied to the tubing string (and through treatment apertures) will cause the cup seals to seal against the casing. If no perforation is present within that interval, the hydraulic pressure within the interval will be maintained between the cups, and further pressurized fluid in the tubing will be forced/jetted through the nozzles 26. Fluid jetted from the nozzles will perforate or erode the casing and, upon continued fluid application, may pass down the wellbore to open perforations in other permeable zones. Typically, the fluid jetted from nozzles 26 will be abrasive fluid, as generally used in sand jet perforating techniques known in the prior art.

Once jetting is accomplished, fluid delivery is typically terminated and the pressure within the tubing string and straddled interval is dissipated. The tool may then be moved to initiate a further perforation, or a treatment operation.

EXAMPLE 3

Method for Shifting Sliding Sleeve Using Tool Deployed on Coiled Tubing

With reference to the tool assembly shown in FIG. 1 and the sliding sleeve shown in FIG. 4, a method is provided for mechanically shifting a sliding sleeve using a tool deployed downhole on coiled tubing, by application of downhole force to the tool assembly.

The wellbore is cased, with ported subs used to join adjacent lengths of tubing at locations corresponding to where treatment may later be desired. The casing is assembled and cemented in hole with the ports in the closed position, as secured by shear pin 43.

A completion tool having the general configuration as shown in FIG. 1 is attached to coiled tubing and is lowered downhole to a location below the lowermost ported casing collar. The collar locator 13 is of a profile corresponding with the space in the lower end of collar 40. That is, the radially enlarged annular space defined between the lowermost edge 51*b* of the sliding sleeve and the lowermost inner surface 51*a* of the collar when the sleeve is in the port closed position.

As the tool is slowly pulled upward within the wellbore, the collar locator 13 will become engaged within the above-mentioned radially enlarged annular space, identifying to the operator the position of the tool assembly at the lowermost ported collar to be opened and treated. The packer 11 is set by application of mechanical force to the tubing string, with the aid of mechanical slips 14 to set the packer against the inner surface of the sleeve. Application of this mechanical force will also close the equalization valve 11 such that the wellbore above the packer is hydraulically sealed from the wellbore below. As further mechanical pressure is applied to the coiled tubing, additional downward force may be applied by delivering treatment fluid down the wellbore annulus (and to down the coiled tubing to the extent that will avoid collapse of the tubing). As pressure against the packer, and sliding sleeve 41, builds, the shear pin 43 will shear. The sleeve simultaneously shift down the casing collar to open (or unblock) the ports 42 in the casing collar, allowing treatment fluid to enter the ports and reach the formation. When the sleeve moves down, the collar locator dogs are pushed out of the locating profile. After the zone is treated, the collar locator can move freely through the sleeve since the mandrel is now covering the indicating profile. Free uphole movement of the collar locator past the sleeve confirms that the sleeve is shifted.

During treatment, the operator is monitoring wellbore conditions as in Examples 1 and 2 above. Should it be determined that fluid is not being delivered to the formation through the ports, attempts may be made to use alternate circulation flowpaths to clear a blockage. Should these further attempts to treat the wellbore continue to be unsuccessful, fluid can be delivered at high volumes through the tubing to jet fluid from the perforation nozzles 10 in the tool assembly, while the equalization valve 12 remains closed, to jet new perforations through the casing. The operator may wish to unset the packer and adjust the position of the assembly to prior to jetting such new perforations. Upon re-perforation, treatment of the formation may be continued.

After treatment of the lowermost ported collar is complete, the packer 11 is unset from the wellbore, and the work string is pulled upward until the collar locator engages within another ported collar. The process is repeated, working upwards to surface. This progression, in an upward direction, enables each opened ported collar to be treated in isolation from the remaining wellbore intervals, as only a single opened port will be present above the set packer for each treatment application.

The tool may also be configured to open the ports in a downhole direction, and treatment of the formation could be accomplished in any order with or without isolation of each ported collar from the remaining opened collars during treatment.

EXAMPLE 4

Method for Shifting Sliding Sleeve Using Tool Assembly Deployed on Wireline

With reference to FIG. 6, the tool assembly may be lowered downhole on wireline 59. In wells of great depth, or in horizontal wells, the tool assembly may be pumped down the well, with displaced fluid leaving the wellbore through a port or perforation in the toe of the well. For example, a detachable pump down cup 51 may be incorporated into the tool assembly beneath the sealing assembly 52. The pump down cup may be retractable or resettable rather than detachable, to allow inactivation of the pump down cup once the tool assembly has reached the desired location downhole, and may be reactivated if further downhole travel is desired. Further, other pump down mechanisms are possible, such as providing a shifting assembly with a large diameter, or providing an inflatable or otherwise expandable component within the tool assembly.

Once the tool assembly has been lowered to sufficient depth, the pump down cup (if present) may be retracted or released. The tool assembly is then raised while the well is logged, and the tool assembly is positioned within a sliding sleeve to be shifted. The electric setting/releasing tool 58 initiates compression of sealing members 54 of the sealing assembly 52, which are driven outward to seal against the sleeve, aided by mechanical slips 53.

Fluid may then be pumped downhole to exert hydraulic pressure against the set sealing assembly. Once the downhole pressure against the sealing assembly overcomes the force retaining the sliding sleeve in the closed position, the sleeve will be shifted as the sealing assembly is driven down the wellbore. When the sliding sleeve reaches the limit of its slidable travel within the ported housing, further treatment fluid applied to the wellbore will pass through the open port and into the formation. During treatment, bottom hole pressure is sensed by the pressure sensors 55, which may be termperature and/or pressure sensors above and/or below the sealing device, with sensed measurements transmitted to the control module via wireline or other suitable forms of transmission. In this manner, any adverse events may be detected during treatment, and appropriate adjustments to the shifting assembly, sleeve, or method may be made.

Once treatment is complete, pressure is equalized across the sealing member and the sleeve is released from frictional engagement by the tool assembly. If the sliding sleeve is biased to close, the sleeve will return to its original position within the ported housing. Alternatively, the sleeve may remain in shifted position or may be further shifted to an alternate position within the ported housing.

The above-described embodiments of the present invention are intended to be examples only. Each of the features, elements, and steps of the above-described embodiments may be combined in any suitable manner in accordance with the general spirit of the teachings provided herein. Alterations, modifications and variations may be effected by those of skill in the art without departing from the scope of the invention, which is defined solely by the claims appended hereto.

What is claimed is:

1. A method for shifting a sliding sleeve in a horizontal or deviated wellbore, comprising:

providing a deviated wellbore having a sleeve slidably disposed therein providing a work string for use in engaging the sleeve, the work string comprising: a sealing element; and sleeve location means operatively associated with the sealing element;

deploying said work string within the wellbore to position the sealing element proximal to said sleeve;

setting the sealing element across the wellbore to engage the sleeve;

applying a downward force to the sealing element by the application of hydraulic pressure to the wellbore annulus to shift the sliding sleeve.

* * * * *